US010653243B2

(12) United States Patent
Lawson et al.

(10) Patent No.: US 10,653,243 B2
(45) Date of Patent: May 19, 2020

(54) ROCKER/GLIDER RECLINE LINKAGE WITH PROJECTED BACK PIVOT POINT

(71) Applicant: L&P PROPERTY MANAGEMENT COMPANY, South Gate, CA (US)

(72) Inventors: Gregory Mark Lawson, Tupelo, MS (US); Walter Clark Rogers, Jr., New London, NC (US)

(73) Assignee: LEGGETT & PLATT, INC., South Gate, CA (US)

( * ) Notice: Subject to any disclaimer, the term of this patent is extended or adjusted under 35 U.S.C. 154(b) by 190 days.

(21) Appl. No.: 15/657,454

(22) Filed: Jul. 24, 2017

(65) Prior Publication Data

US 2018/0027967 A1 Feb. 1, 2018

Related U.S. Application Data

(60) Provisional application No. 62/368,283, filed on Jul. 29, 2016.

(51) Int. Cl.

| | |
|---|---|
| ***A47C 1/0355*** | (2013.01) |
| ***A47C 1/035*** | (2006.01) |
| ***A47C 1/032*** | (2006.01) |

(52) U.S. Cl.

CPC ..... *A47C 1/0355* (2013.01); *A47C 1/0352* (2013.01); *A47C 1/03211* (2013.01)

(58) Field of Classification Search

CPC .. A47C 1/0355; A47C 1/0352; A47C 1/03211
See application file for complete search history.

(56) References Cited

U.S. PATENT DOCUMENTS

| | | | |
|---|---|---|---|
| 3,730,584 | A | 5/1973 | Uchida |
| 4,071,275 | A | 1/1978 | Rogers, Jr. |
| 4,108,491 | A | 8/1978 | Rogers, Jr. |
| 4,194,783 | A | 3/1980 | Cycowicz et al. |
| 4,591,205 | A | 5/1986 | James |
| 4,815,788 | A | 3/1989 | May |
| 4,904,017 | A | 2/1990 | Ehrlich |

(Continued)

FOREIGN PATENT DOCUMENTS

| | | | |
|---|---|---|---|
| FR | 1255403 | A | 3/1961 |
| WO | 2014139179 | A1 | 9/2014 |

OTHER PUBLICATIONS

Non-Final Office Action dated Nov. 1, 2018 in U.S. Appl. No. 15/657,425, 10 pages.

(Continued)

*Primary Examiner* — Anthony D Barfield

(74) *Attorney, Agent, or Firm* — Shook, Hardy & Bacon, LLP

(57) ABSTRACT

A linkage for use in reclining furniture may include a back bracket supported by forward and rear back pivot links. The bottom of the rear back pivot link may be pivotally coupled to a rear lift link and the bottom of the forward back pivot link may be pivotally coupled to the rear lift link in a different location. A control link may be pivotally coupled on one end to one of the forward back pivot link and the rear back pivot link. The control link may pull the pivoting linkage of the back bracket and the forward and back pivot links as the overall linkage is moved from a closed to a TV to a full-recline position. The resulting pivot point for the back is projected upwardly and forwardly, to a point where an upholstered back and seat meet on a finished chair.

13 Claims, 26 Drawing Sheets

(56) References Cited

U.S. PATENT DOCUMENTS

| | | | |
|---|---|---|---|
| 5,072,988 | A | 12/1991 | Plunk |
| 5,765,913 | A | 6/1998 | LaPointe et al. |
| 5,772,278 | A | 6/1998 | Kowalski |
| 5,795,021 | A | 8/1998 | Rogers |
| 7,396,074 | B2 | 7/2008 | Wiecek |
| 7,850,232 | B2 | 12/2010 | Casteel |
| 8,398,165 | B2 | 3/2013 | Lawson |
| 8,398,169 | B2 | 3/2013 | LaPointe |
| 8,573,687 | B2 | 11/2013 | Lawson et al. |
| 8,616,627 | B2 | 12/2013 | Murphy et al. |
| 8,833,844 | B2 | 9/2014 | LaPointe et al. |
| 8,915,544 | B2 | 12/2014 | LaPointe |
| 8,985,694 | B2 | 3/2015 | Fischer |
| 9,039,078 | B2 | 5/2015 | Lawson et al. |
| 9,247,822 | B2 | 2/2016 | Fischer |
| 9,468,295 | B2 | 10/2016 | Lawson |
| 9,585,477 | B2 | 3/2017 | Huang et al. |
| 9,700,140 | B2 | 7/2017 | Lawson |
| 9,844,269 | B2 | 12/2017 | Bryant |
| 9,845,852 | B2 | 12/2017 | Lawson et al. |
| 10,021,980 | B2 | 7/2018 | Lawson |
| 2002/0043823 | A1 | 4/2002 | Wiecek |
| 2010/0127556 | A1 | 5/2010 | Hoffman et al. |
| 2011/0175404 | A1 | 7/2011 | Lawson |
| 2011/0248536 | A1 | 10/2011 | LaPointe |
| 2012/0049606 | A1 | 3/2012 | Lawson et al. |
| 2012/0112519 | A1 | 5/2012 | Murphy et al. |
| 2013/0200659 | A1 | 8/2013 | Hoffman et al. |
| 2013/0257110 | A1 | 10/2013 | Fischer |
| 2014/0333108 | A1 | 11/2014 | Fischer |
| 2015/0108812 | A1 | 4/2015 | Huang et al. |
| 2016/0029800 | A1 | 2/2016 | Bryant |
| 2016/0045031 | A1 | 2/2016 | Lawson |
| 2016/0100687 | A1 | 4/2016 | Murphy et al. |
| 2016/0273632 | A1 | 9/2016 | Lawson et al. |
| 2017/0042330 | A1 | 2/2017 | Bruce et al. |
| 2017/0258230 | A1 | 9/2017 | Huang et al. |

OTHER PUBLICATIONS

Communication under Rule 71(3) dated Apr. 25, 2019 in European Patent Application No. 17183598.6, 7 pages.

Notice of Allowance dated Sep. 6, 2018 in U.S. Appl. No. 15/485,711, 9 pages.

Communication pursuant to Article 94(3) dated Oct. 18, 2018 in European Patent Application No. 17183598.6, 5 pages.

Notice of Allowance dated May 13, 2019 in U.S. Appl. No. 15/657,425, 7 pages.

Extended Search Report dated Feb. 19, 2018 in European Patent Application No. 17183598.6, 8 pages.

Extended Search Report dated Feb. 19, 2018 in European Patent Application No. 17182541.7, 7 pages.

Extended Search Report dated Apr. 25, 2018 in European Patent Application No. 17183713.1, 8 pages.

Communication under Rule 71(3) dated Jan. 10, 2019 in European Patent Application No. 17183713.1, 35 pages.

Notice of Allowance dated Apr. 3, 2019 in U.S. Appl. No. 15/657,425, 7 pages.

Extended search report dated Oct. 28, 2019 in European Patent Application No. 19186712.6, 8 pages.

ROCKER/GLIDER RECLINE LINKAGE WITH PROJECTED BACK PIVOT POINT

CROSS-REFERENCE TO RELATED APPLICATIONS

This application claims priority to U.S. Provisional Application No. 62/368,283 filed Jul. 29, 2016. The entirety of the aforementioned application is incorporated by reference herein.

BACKGROUND

Glider-recliner (glider) and rocker-recliner (rocker) chairs are generally well known in the furniture industry. The terms glider and rocker are used throughout this description to describe articles of furniture that include a reclining mechanism, either with a glider feature or with a rocking feature. Generally rockers are chairs that allow the user to rock as well as recline and are equipped with extendable footrests. Rockers are often in the form of a plush chair, however, they might also take the form of an oversized seat, a seat-and-a-half, a love seat, a sofa, a sectional, and the like. Gliders are chairs that allow the user to reciprocate back-and-forth in a gliding motion. Gliders and rockers are known in both a manual configuration (where the user releases the mechanism from closed to TV, and moves the mechanism from TV to full recline) and a motorized version (where a motor is used to move the mechanism between the various positions).

The reclining motion is achieved in rocker and glider chairs with a linkage mechanism that is coupled to the base and/or a rocker or glider mechanism. The linkage mechanisms found in rockers and gliders in the art include a plurality of interconnected links that provide one or more mechanisms for extending a footrest, reclining the chair, and obstructing movements of the chair when in specific orientations. Typically, rockers and gliders known in the art provide three positions: an upright seated position with the footrest retracted beneath the chair, a television viewing or TV position in which the chair back is slightly reclined but still provides a generally upright position with the footrest extended, and a full-recline position in which the chair back is reclined an additional amount farther than in the TV position but still generally inclined with respect to the seat of the chair and with the foot rest extended. For rockers, the chair is permitted to rock when in the closed position, and for gliders, the chair is permitted to glide when in the closed position.

These types of prior art recliner mechanisms, while functional, suffer from a number of drawbacks. One of which includes a problem known as shirt pull. Shirt pull occurs as the user reclines the back of the chair, and the chair back rotates back, but also away from the seat, increasing the distance between the bottom of the back cushion and the back of the seat cushion. This movement not only results in shirt pull, but also removes support from the lower lumbar area of the user seated in the chair. This motion is caused by a back bracket pivot point that is typically below and behind the point where the chair back cushion and the seat cushion meet. It would be desirable to provide a rocker and/or glider (whether manual or powered) having a back pivot point projected to as close as possible to the point at which the bottom of the back cushion and the back of the seat cushion meet.

Further, rockers and gliders typically have different linkage configurations resulting in different parts for gliders versus rockers. It would be desirable to share as many parts as possible between rockers and gliders from a manufacturing standpoint.

In power rockers and gliders, the motor is typically connected to the front ottoman link to drive the chair from closed, to TV to full-recline positions. This connection results in the motor traveling in an arcuate motion, and raises the motor near the bottom of the seat. It would be desirable to provide a motorized glider and rocker that allowed the motor to be mounted lower, and maintained lower throughout its movement, as well as to travel in a more-linear motion.

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

In an embodiment of the invention a linkage for use in reclining furniture is described. The linkage includes a back bracket supported by forward and rear back pivot links. The bottom of the rear back pivot link is pivotably coupled to a rear lift link, and the bottom of the forward back pivot link is pivotably coupled to the rear lift link in a different location. A control link is pivotably coupled on one end to one of the forward back pivot link, or the rear back pivot link. The control link operates to pull the pivoting linkage of the back bracket, and the forward and rear back pivot links as the overall linkage is moved from a closed to a TV and to a full-recline position. The resulting pivot point for the back is projected upwardly and forwardly, to a point where an upholstered back and seat meet on a finished chair, resulting in far less shirt pull than in previously known mechanisms and chairs. During recline, the bottom of the back of the chair will follow the user, offering full support of the user's back, even in the full-recline position.

In another embodiment, a power linkage is described having a motor mounting linkage that allows the motor to travel in a less-arcuate motion than in past mechanisms, as well as holding the motor lower, in relation to the seat, than in past mechanisms.

DESCRIPTION OF THE DRAWINGS

Illustrative embodiments of the invention are described in detail below with reference to the attached drawing figures, and wherein.

DETAILED DESCRIPTION

The subject matter of embodiments of the invention is described with specificity herein to meet statutory requirements. But the description itself is not intended to necessarily limit the scope of claims. Rather, the claimed subject matter might be embodied in other ways to include different steps, components, or combinations thereof, in conjunction with other present or future technologies. Terms should not be interpreted as implying any particular order among or between various steps herein disclosed unless and except when the order of individual steps is explicitly described.

Figure 1:
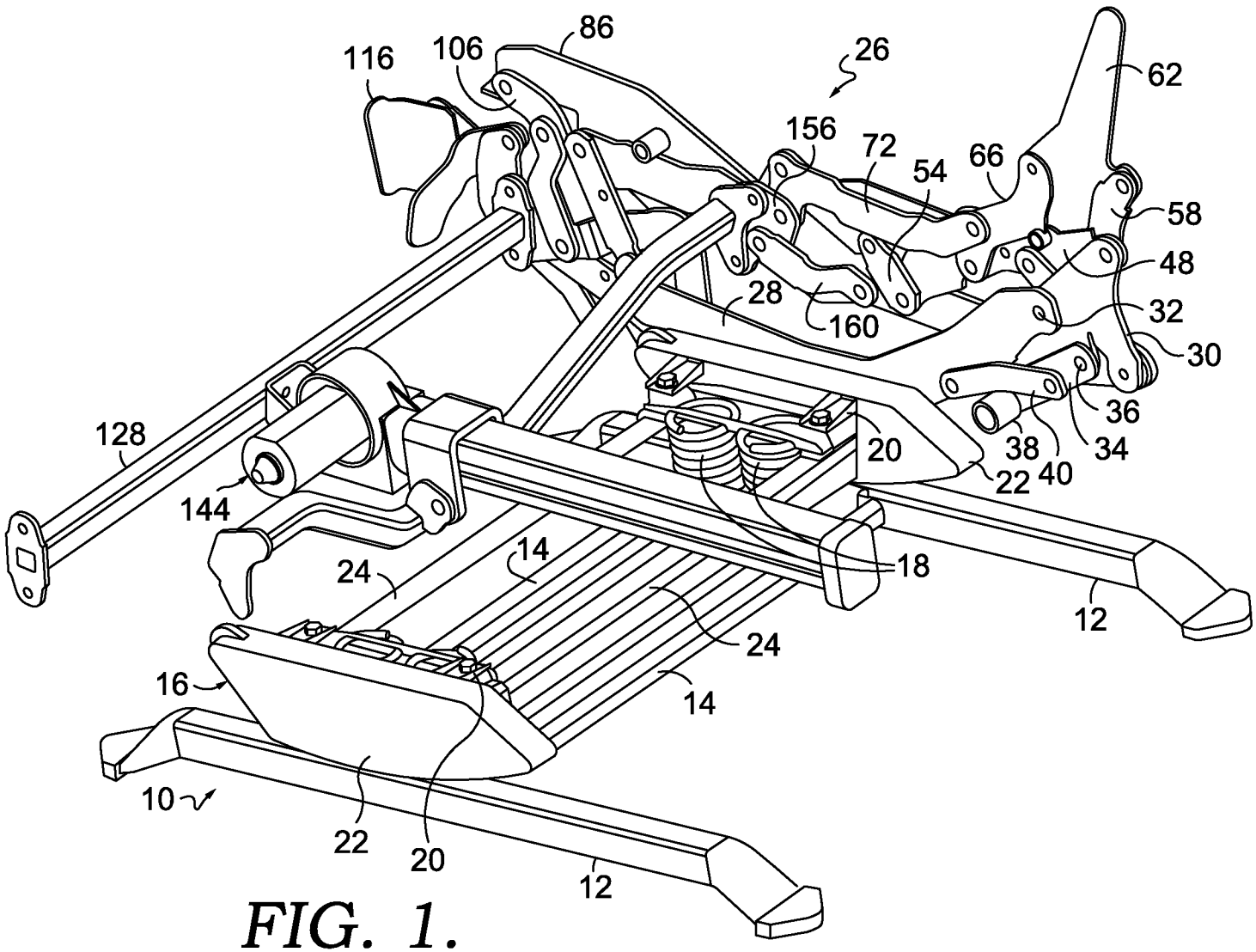
FIG. 1 is a perspective view of an exemplary power rocker-recliner chair base in a closed position in accordance with an embodiment of the invention.

Referring to the drawings and initially to FIG. 1, a rocker-recliner base 10 is shown in an upright position in accordance with an embodiment of the invention. The rocker-recliner base 10 couples together a footrest, chair back, chair arms and a chair seat of a rocker chair. For the sake of clarity, these portions of the chair are not shown. The base 10 includes a pair of spaced apart base rails 12, typically made from tubular steel. The base rails support the remainder of the base 10 above the surface on which the chair is placed. Cross tubes 14 extend between and are affixed to the base rails 12, such as by welding. A rocker assembly 16 is coupled to the cross tubes. The rocker assembly 16 includes a lower spring retainer (not shown) coupled to the cross tubes 14, a pair of springs 18 secured on their lower ends to the lower spring retainer on each side of the base 10, and secured on their upper ends to an upper spring retainer 20. The upper spring retainer 20 is coupled to a rocker cam 22. Rocker cam 22 can be made from any of a number of materials, such as wood, metal or molded plastic. Cross rails 24 extend between the rocker cams and are coupled to the rocker cams. While the rocker base is described above, and shown in the Figures, many other configurations for a rocker assembly could be used in embodiments described below.

A recline mechanism 26 is coupled to each side of the rocker base 10. Only one mechanism 26 is shown in the Figures, for clarity, with the removed side being a mirror-image of the side that is shown. The recline mechanism 26 is coupled to the rocker base through a base plate 28. The base plate 28 extends upward from the rocker base and extends forwardly and rearwardly of the rocker cam 22. The base plate 28, like the remainder of the links described below is typically made from steel. The upper, rearward end of base plate 28 is pivotably coupled to a rear pivot link 30 at pivot point 32. Rear pivot link 30 has a generally triangular shape, as shown. Rearwardly and below pivot point 32 (as viewed in FIGS. 1-3), rear pivot link 30 is pivotably coupled to a wheel link 34 at pivot point 36. The outer end of wheel link 34 has a wheel 38 pivotably coupled to it. A wheel control link 40 is pivotably coupled to, and between, base plate 28 and wheel link 34. The wheel link 34 and wheel control link 40 operate as known in other existing mechanisms. As best seen in FIG. 3, the lower end of rear pivot link 30 is pivotably coupled to a footrest drive link 42 through a roller (not shown) that rides within a slot 44 on a sequence link 46. The opposite end of sequence link 46 is pivotably coupled to a rear lift link 48 at pivot point 50. Sequence link 46 thus extends between rear lift link 48 and rear pivot link 30, and is also coupled to footrest drive link 42.

Figure 2:
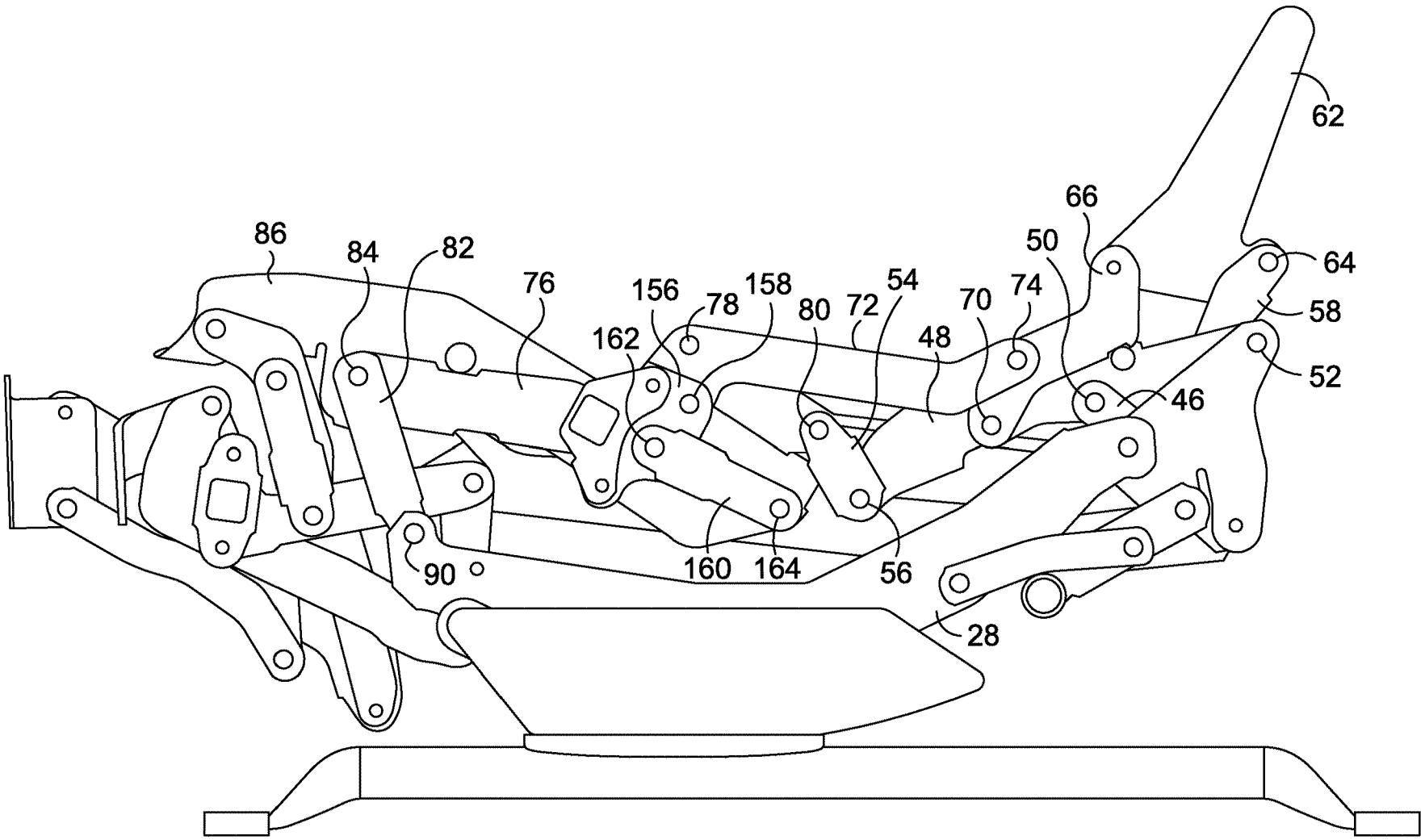
FIG. 2 is an inside, cross-sectional view of the rocker mechanism of FIG. 1 in accordance with an embodiment of the invention.
Figure 3:
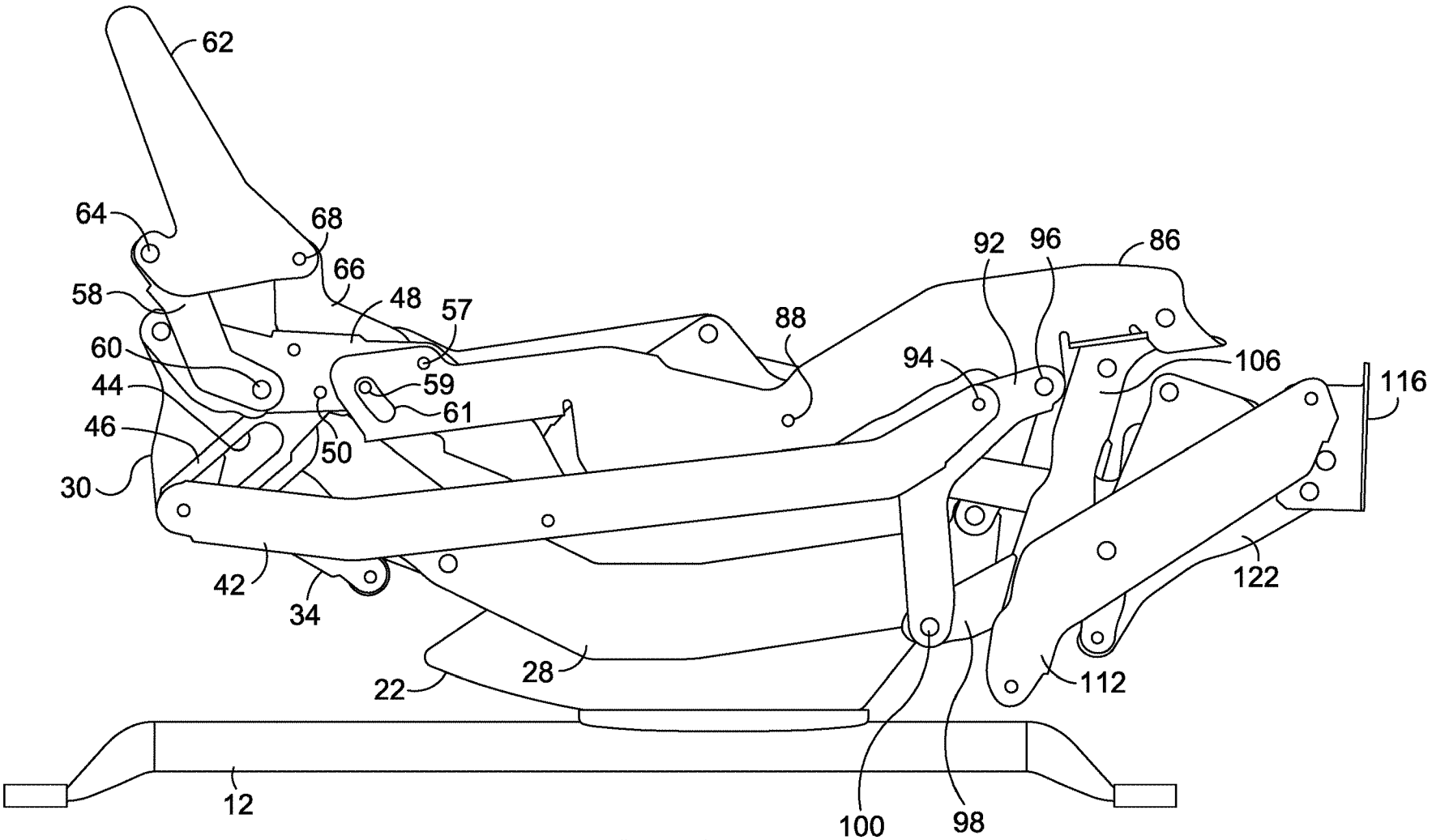
FIG. 3 is an outside elevation view of the chair base of FIG. 1 in accordance with an embodiment of the invention.

As best seen in FIG. 2, the rear lift link 48 is pivotably coupled on its rearward end to rear pivot link 30 at pivot point 52. The opposite end of rear lift link 48 is pivotably coupled to a connector link 54 and pivot point 56. The rear lift link 48 thus extends between, and is pivotably coupled to, the rear pivot link 30 and the connector link 54. As best seen in FIG. 3, the rear lift link 48 is also pivotally coupled to a seat mounting plate 86 at pivot point 57. In some aspects, the rear lift link 48 includes a rivot 59 that is slidably received in a slot 61 formed in the seat mounting plate 86. The rivot 59 serves as a stop within the slot 61 as the recline mechanism 26 opens. With continuing reference to FIG. 3, a rear back pivot link 58 is pivotably coupled to rear lift link 48 at pivot point 60. The opposite end of rear back pivot link 58 is pivotably coupled to back bracket 62 at pivot point 64. The back bracket 62 is shaped as shown, with an upper extending leg that is used to couple the back bracket 62 to a back of the chair. The forward, lower area of back bracket 62 is pivotably coupled to an upper end of a forward back pivot link 66 and pivot point 68. The lower end of forward back pivot link 66 is pivotably coupled to rear lift link 48 at pivot point 70.

As best seen in FIG. 2, a rearward end of a control link 72 is pivotably coupled to the forward back pivot link 66 at pivot point 74. The forward end of control link 72 is pivotably coupled to a front lift link 76 at pivot point 78. The front lift link 76 is pivotably coupled on its rear end to the upper end of connector link 54 at pivot point 80. A forward end of front lift link 76 is pivotably coupled to the upper end of a front pivot link 82 at pivot point 84. Below pivot point 78, front lift link 76 is also pivotably coupled to the seat mounting plate 86 at pivot point 88 (see FIG. 3). The lower end of front pivot link 82 is pivotably coupled to base plate 28 at pivot point 90.

Figure 4:
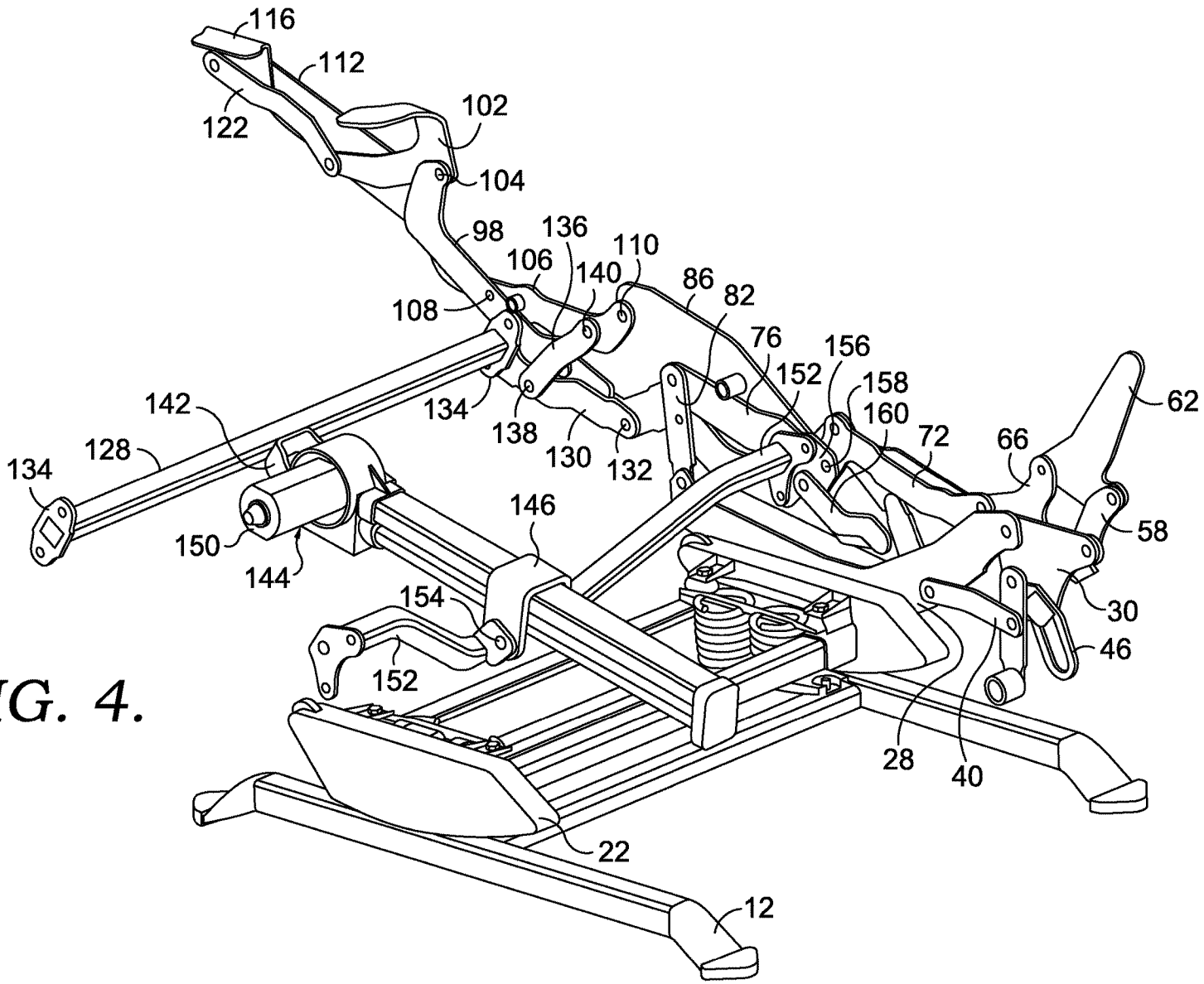
FIG. 4 is a perspective view of the rocker chair base of FIG. 1 in a TV position in accordance with an embodiment of the invention.
Figure 5:
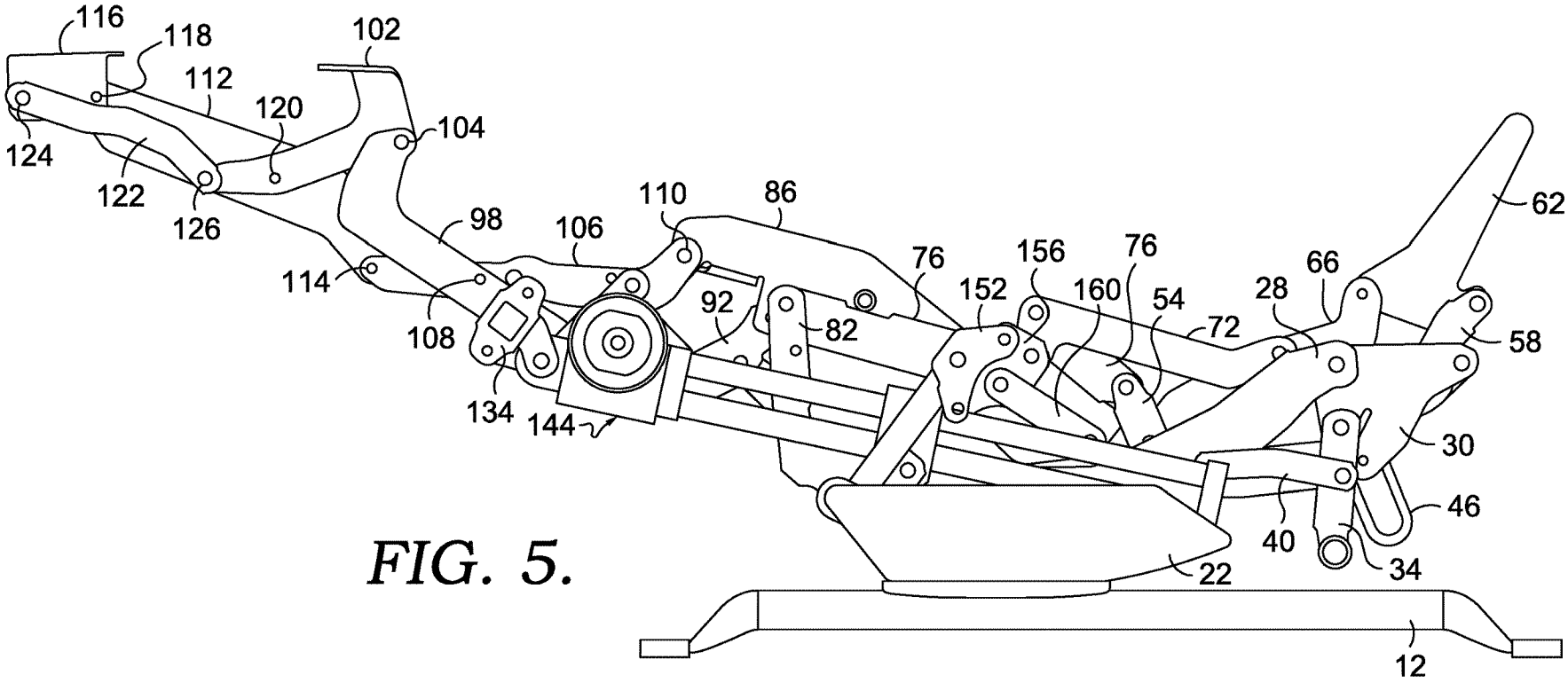
FIG. 5 is an inside, cross-sectional view of the rocker mechanism of FIG. 4 in accordance with an embodiment of the invention.

As best seen in FIG. 3, footrest drive link 42 extends from the connection to sequence link 46 and rear pivot link 30 forwardly and is pivotably connected on its forward end to a rear ottoman link 92 at pivot point 94. Rear ottoman link 92 is pivotably coupled on its upper end to seat mounting plate 86 at pivot point 96. The opposite end of rear ottoman link 92 is pivotably coupled to a footrest extension link 98 at pivot point 100 (see FIG. 6). The end of footrest extension link 98 opposite pivot point 100 is pivotably coupled to a mid-ottoman bracket 102 and pivot point 104. Additionally, footrest extension link 98 is pivotably coupled, generally at a mid-point, to a front ottoman link 106 at pivot point 108. Front ottoman link 106 is pivotably coupled on one end to seat mounting plate 86 at pivot point 110 (see FIG. 5), and is pivotably coupled on the other end to a wide ottoman link 112 at pivot point 114. The wide ottoman link 112 is pivotably coupled on its other end to an ottoman bracket 116 at pivot point 118. As seen in FIG. 5, a mid-point of the mid-ottoman bracket 102 is pivotably coupled to the wide ottoman link 112 at pivot point 120. A footrest control link 122 is pivotably coupled on one end to ottoman bracket 116 at pivot point 124, and is pivotably coupled on the other end to mid-ottoman bracket 102 at pivot point 126. The ottoman linkage described above can be moved from a closed position in FIGS. 1-3, to an extended position as shown in FIGS. 4-9.

Figure 7:
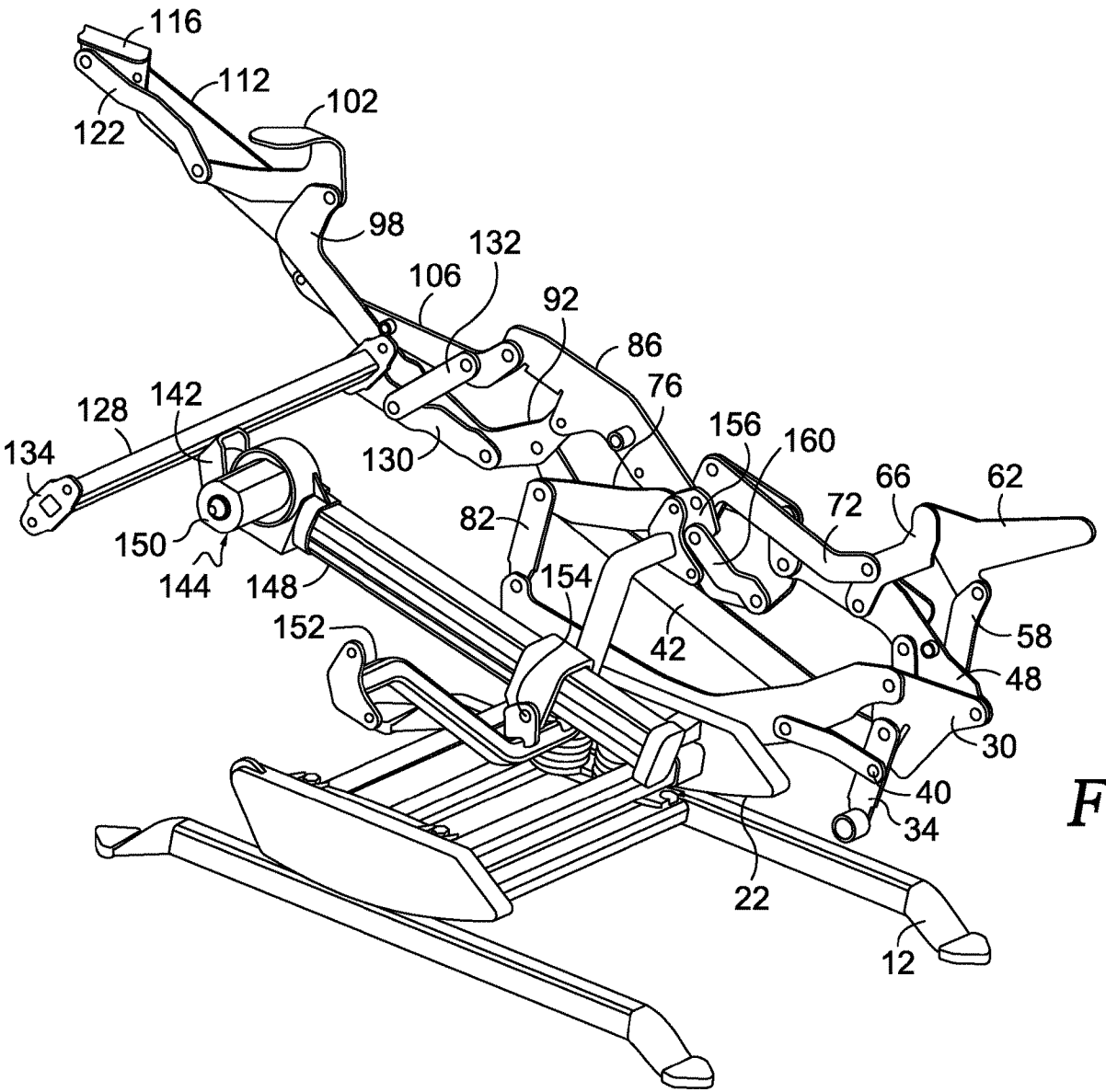
FIG. 7 is a perspective view of the rocker chair base of FIG. 1 in a fully-reclined position in accordance with an embodiment of the invention.

The recline mechanism 26 described above can be implemented as a motorized or a manual version, depending on the desired end use. As a motorized version, as best seen in FIGS. 1, 4 and 7, a motor tube 128 is secured to, and between, rear ottoman links 92. More specifically, a motor tube bracket 130 is pivotably secured to the rear ottoman link 92 at pivot point 132. On the opposite end of motor tube bracket 130, an end cap 134 is fixedly coupled to the motor tube bracket 130. The end caps 134 are coupled to the motor tube 128, such as by welding. A control link 136 is pivotably coupled to the motor tube bracket 130 at pivot point 138, and pivotably coupled to the front ottoman link 106 at pivot point 140. A clevis 142 is fixedly coupled to motor tube 128 midway along motor tube 128, facilitating a pivotable coupling to one end of a motor 144. Motor 144 is also coupled to recline mechanism 26 through a drive block 146 which moves along a track 148 in relation to the motor body 150. A rear motor tube 152 is pivotably coupled to drive block 146 at pivot point 154 located below the track 148. The rear motor tube 152 is fixedly coupled on its opposite end to a motor bell crank 156. The motor bell crank 156 is pivotably coupled to control link 72 at pivot point 158. Additionally, motor bell crank 156 is pivotably coupled to seat mounting plate 86 through a strut 160 via pivot points 162 and 164. The motor bell crank 156 is thus connected between the seat mounting plate 86 and the front lift link 76 through the control link 72 and the strut 160.

Figure 6:
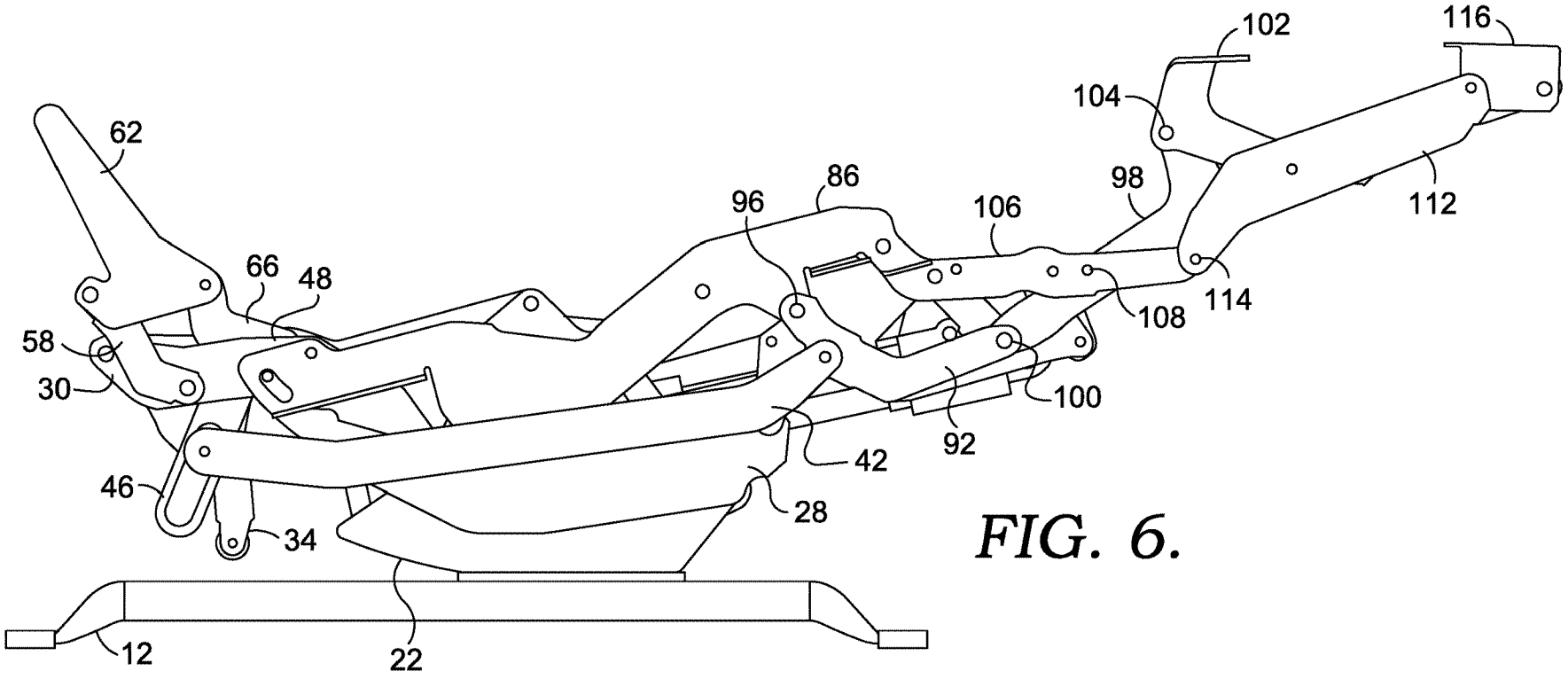
FIG. 6 is an outside elevation view of the mechanism of FIG. 4 in accordance with an embodiment of the invention.
Figure 8:
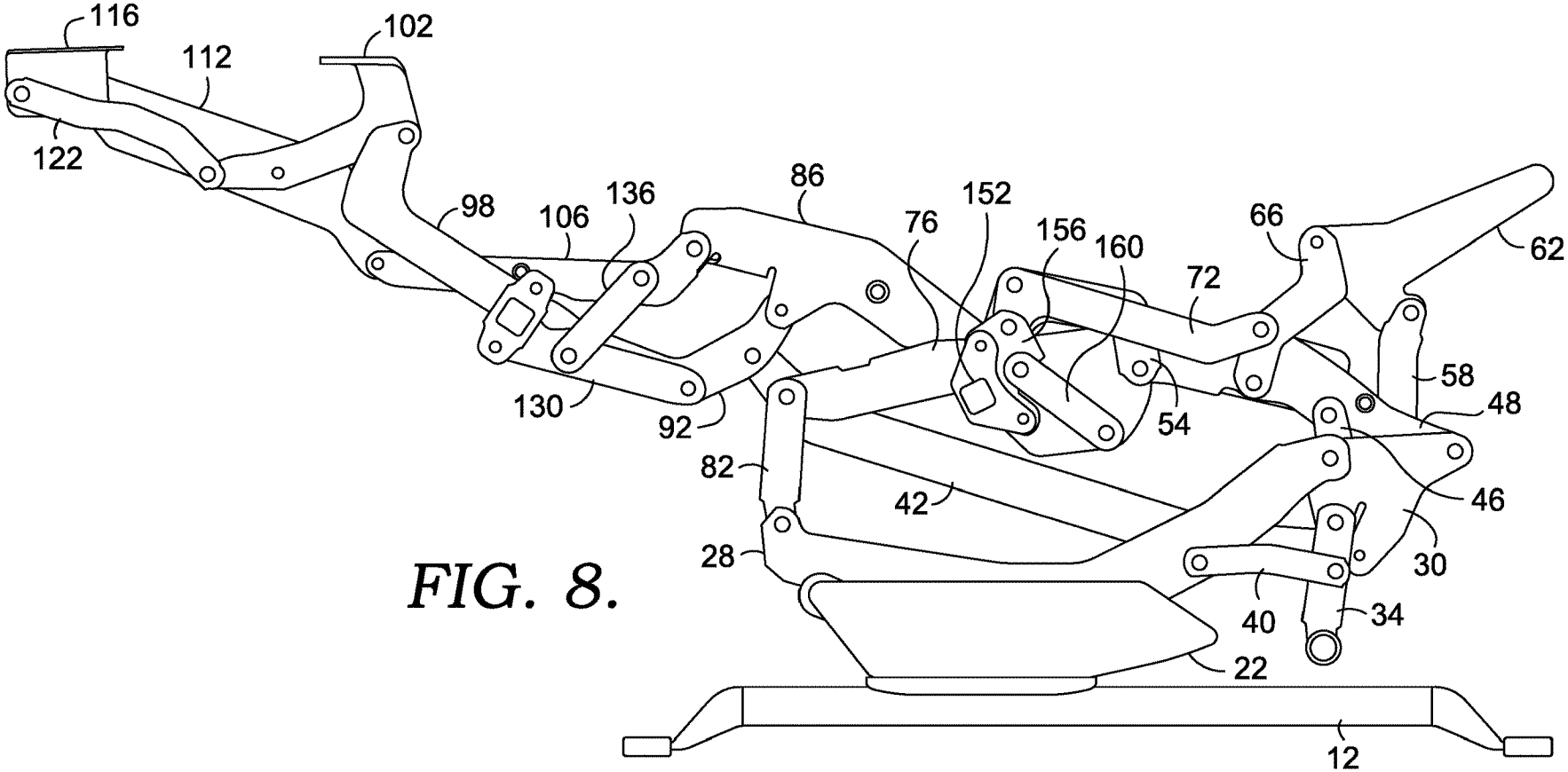
FIG. 8 is an inside, cross-sectional view of the rocker mechanism of FIG. 7 in accordance with an embodiment of the invention.
Figure 9:
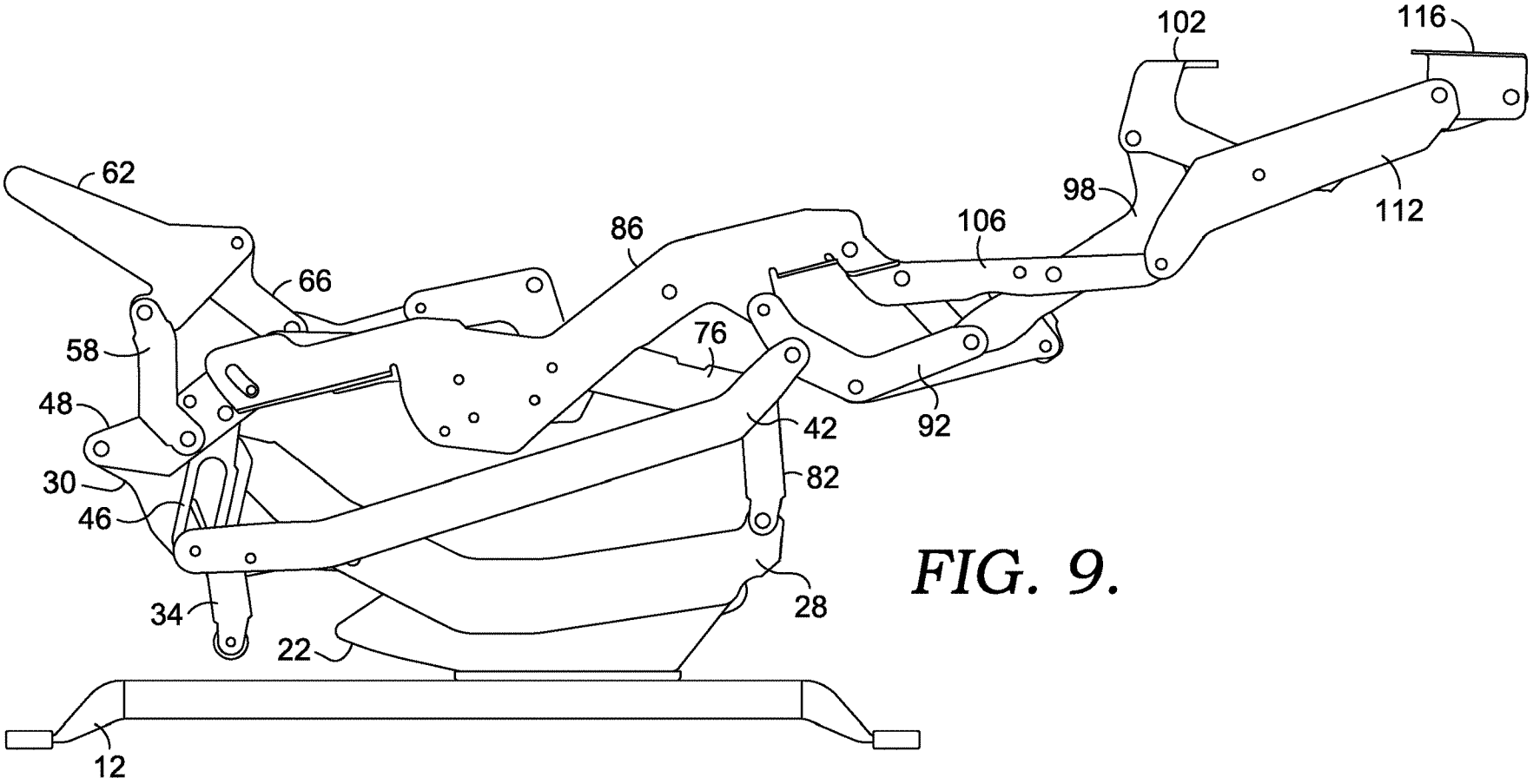
FIG. 9 is an outside elevation view of the mechanism of FIG. 7 in accordance with an embodiment of the invention.
Figure 10:
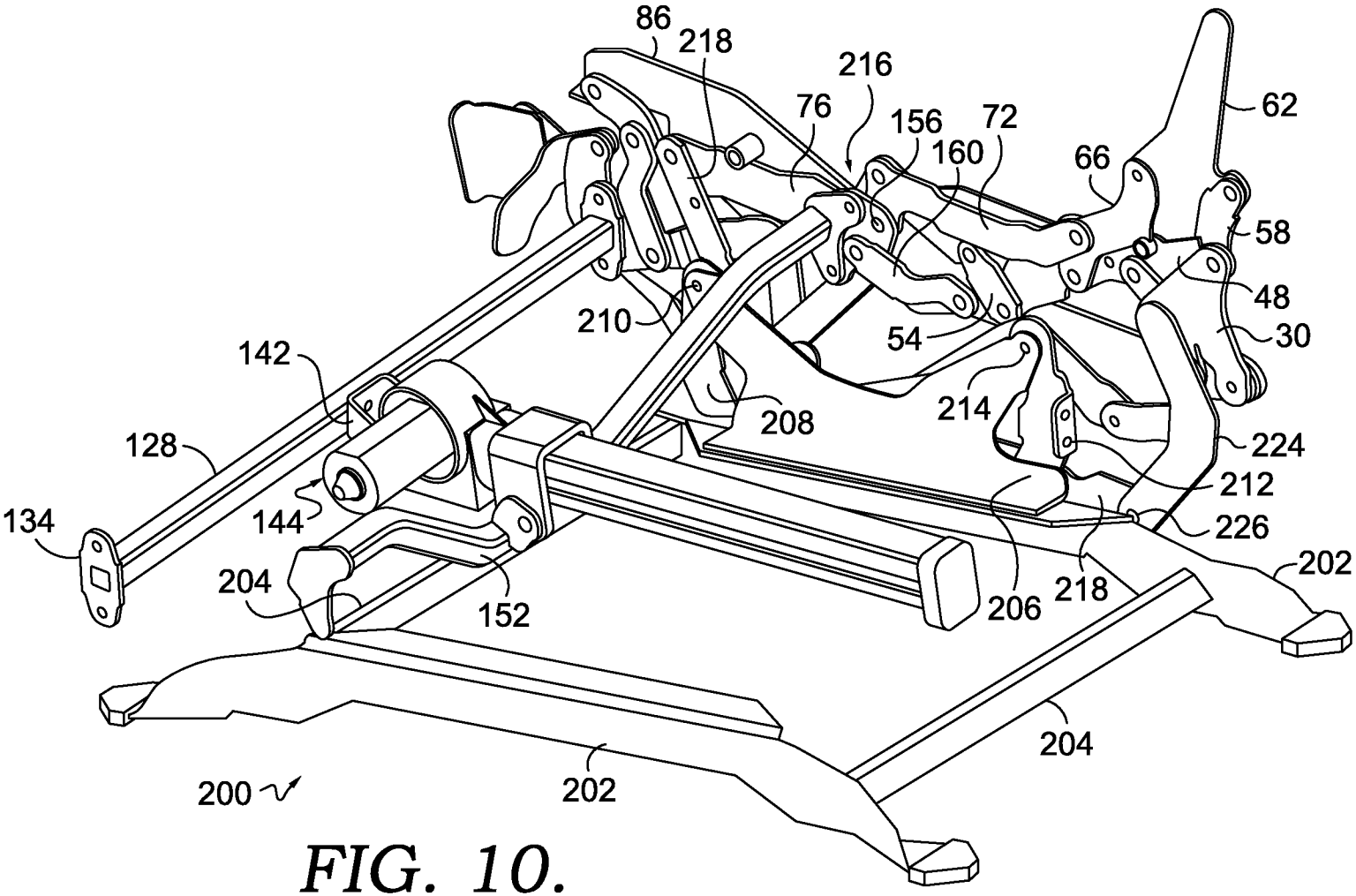
FIG. 10 is a perspective view of an exemplary power glider-recliner chair base in a closed position in accordance with an embodiment of the invention.
Figure 11:
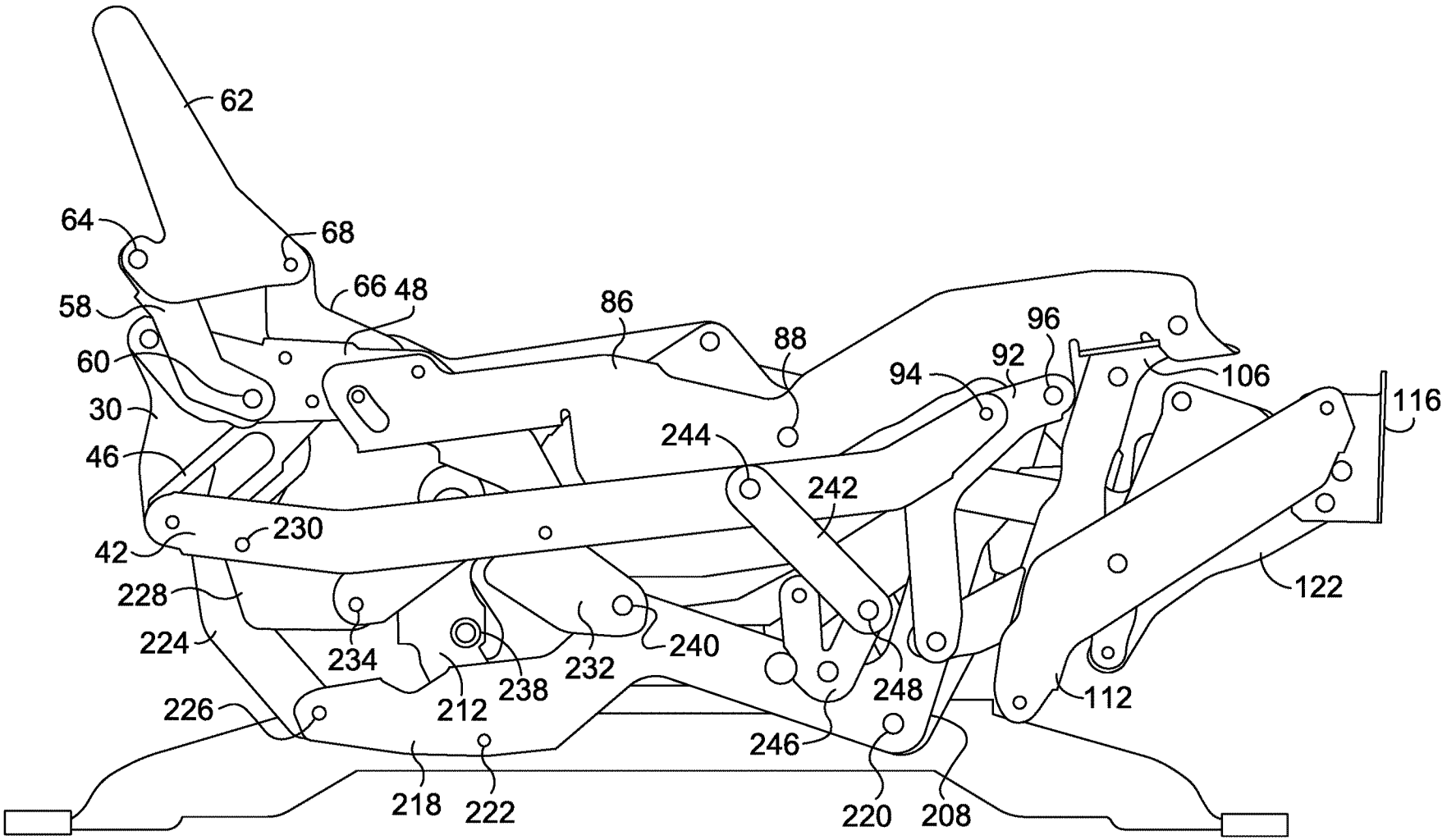
FIG. 11 is an outside elevation view of the chair base of FIG. 10 in accordance with an embodiment of the invention.
Figure 12:
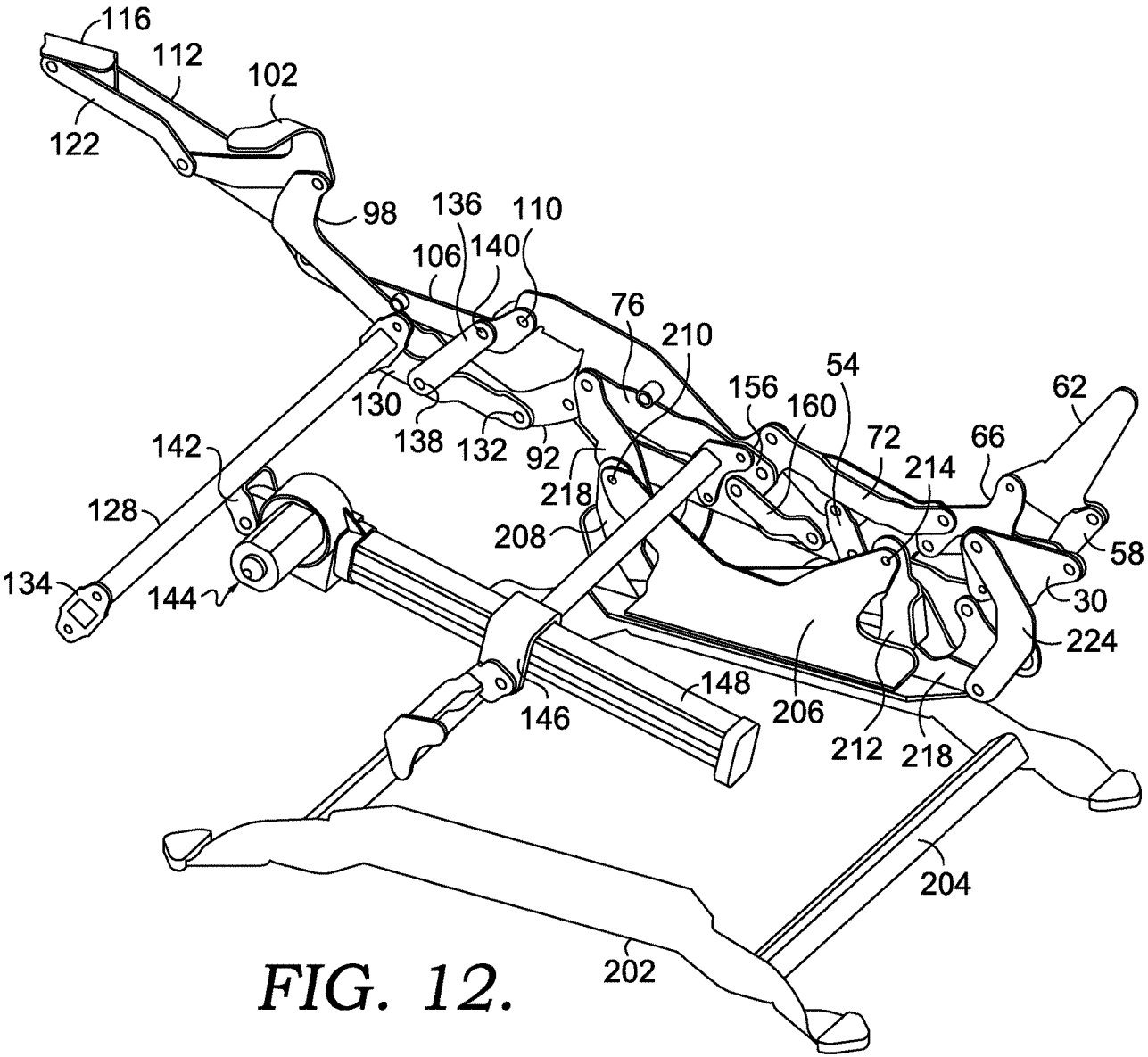
FIG. 12 is a perspective view of the glider chair base of FIG. 10 in a TV position in accordance with an embodiment of the invention.
Figure 13:
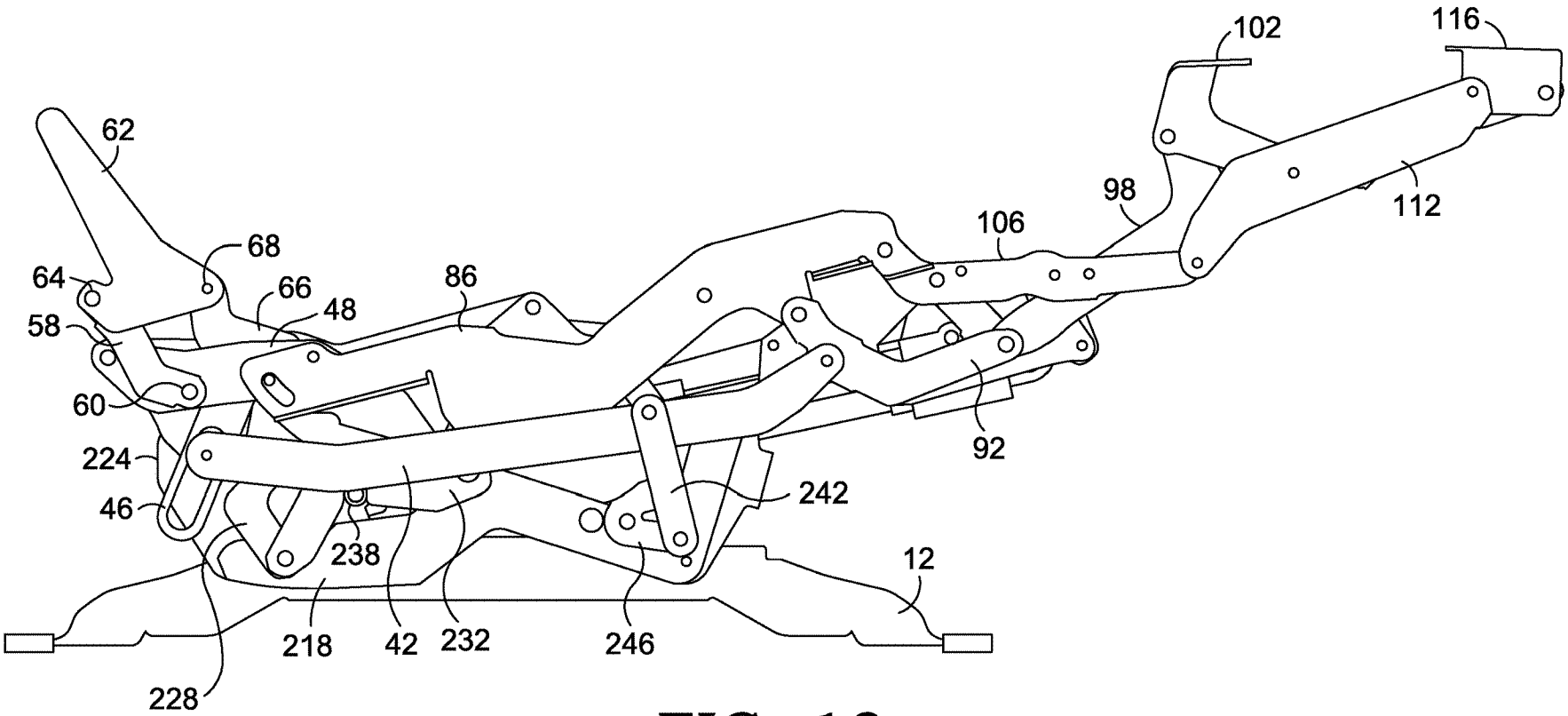
FIG. 13 is an outside elevation view of the mechanism of FIG. 12 in accordance with an embodiment of the invention.
Figure 14:
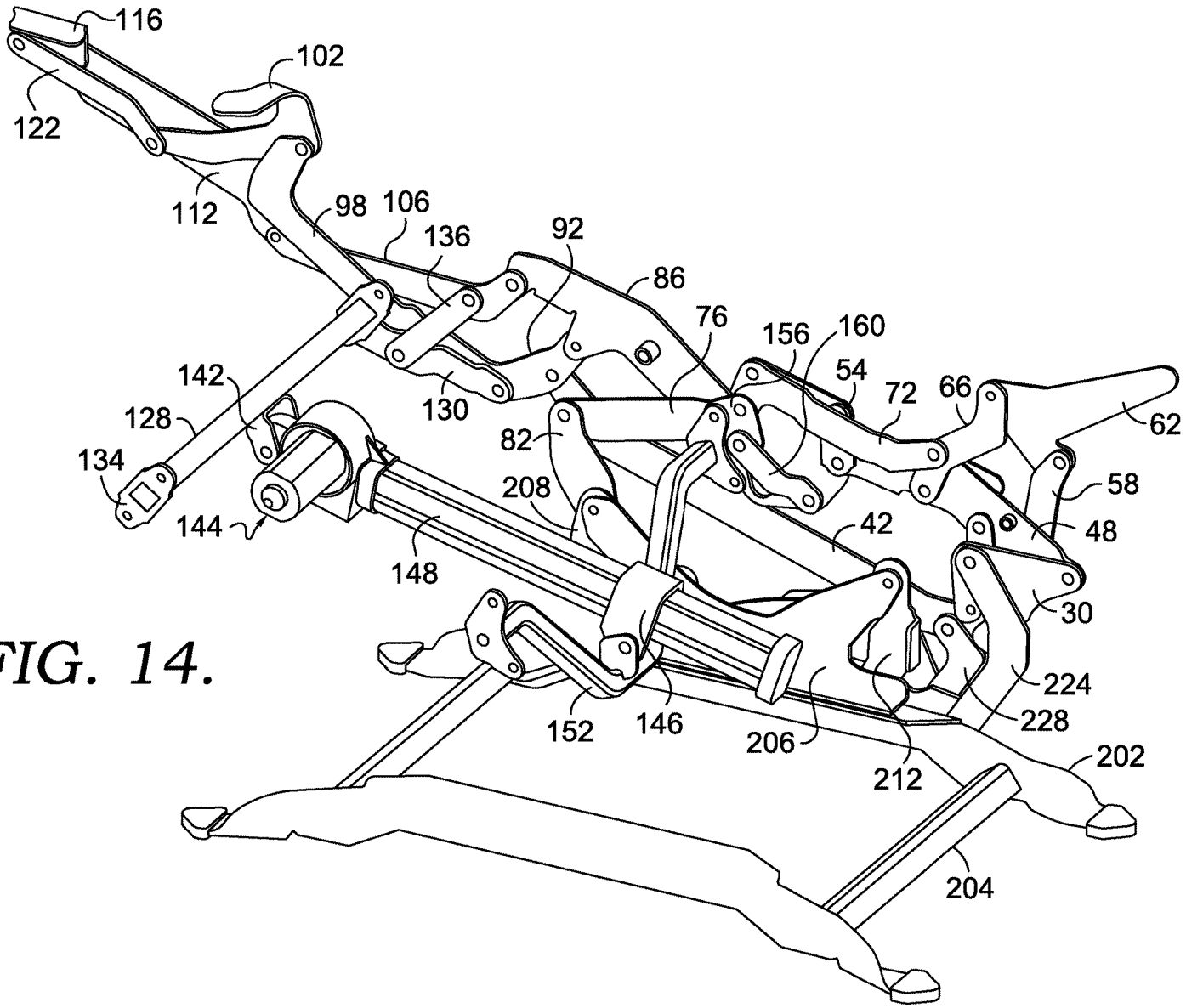
FIG. 14 is a perspective view of the glider chair base of FIG. 10 in a fully-reclined position in accordance with an embodiment of the invention.
Figure 15:
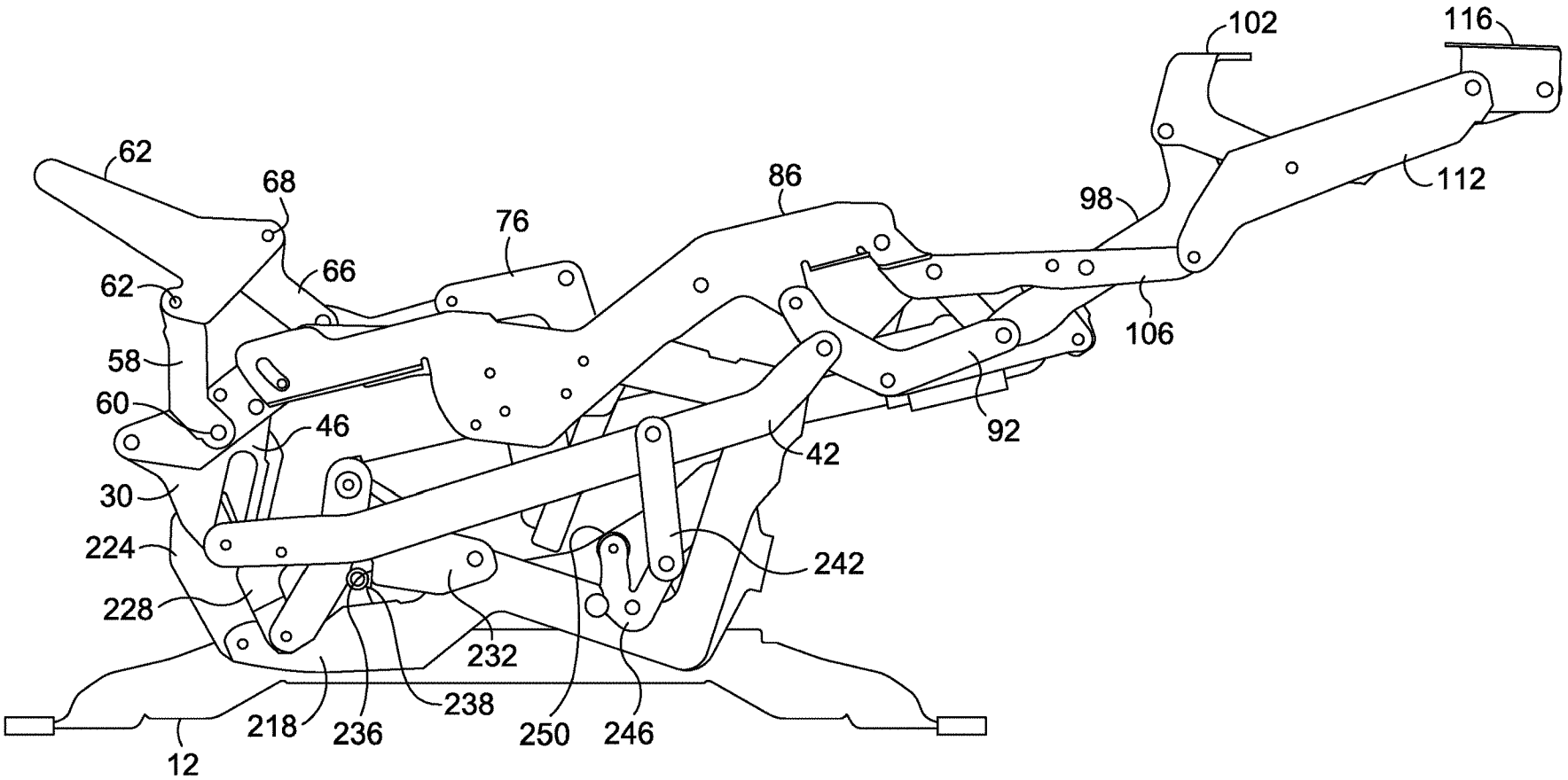
FIG. 15 is an outside elevation view of the mechanism of FIG. 14 in accordance with an embodiment of the invention.
Figure 16:
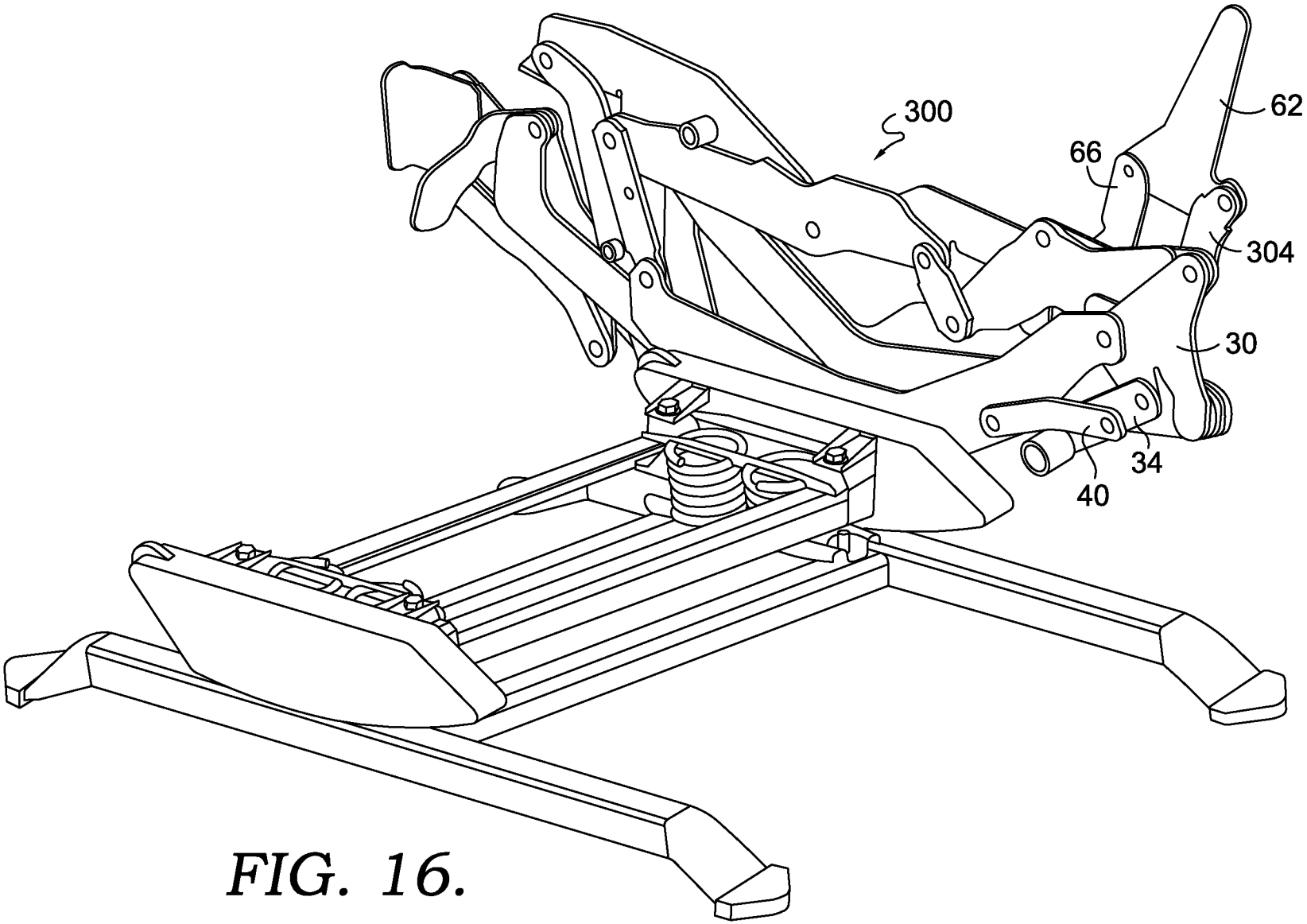
FIG. 16 is a perspective view of an exemplary manual rocker-recliner chair base in a closed position in accordance with another embodiment of the invention.
Figure 17:
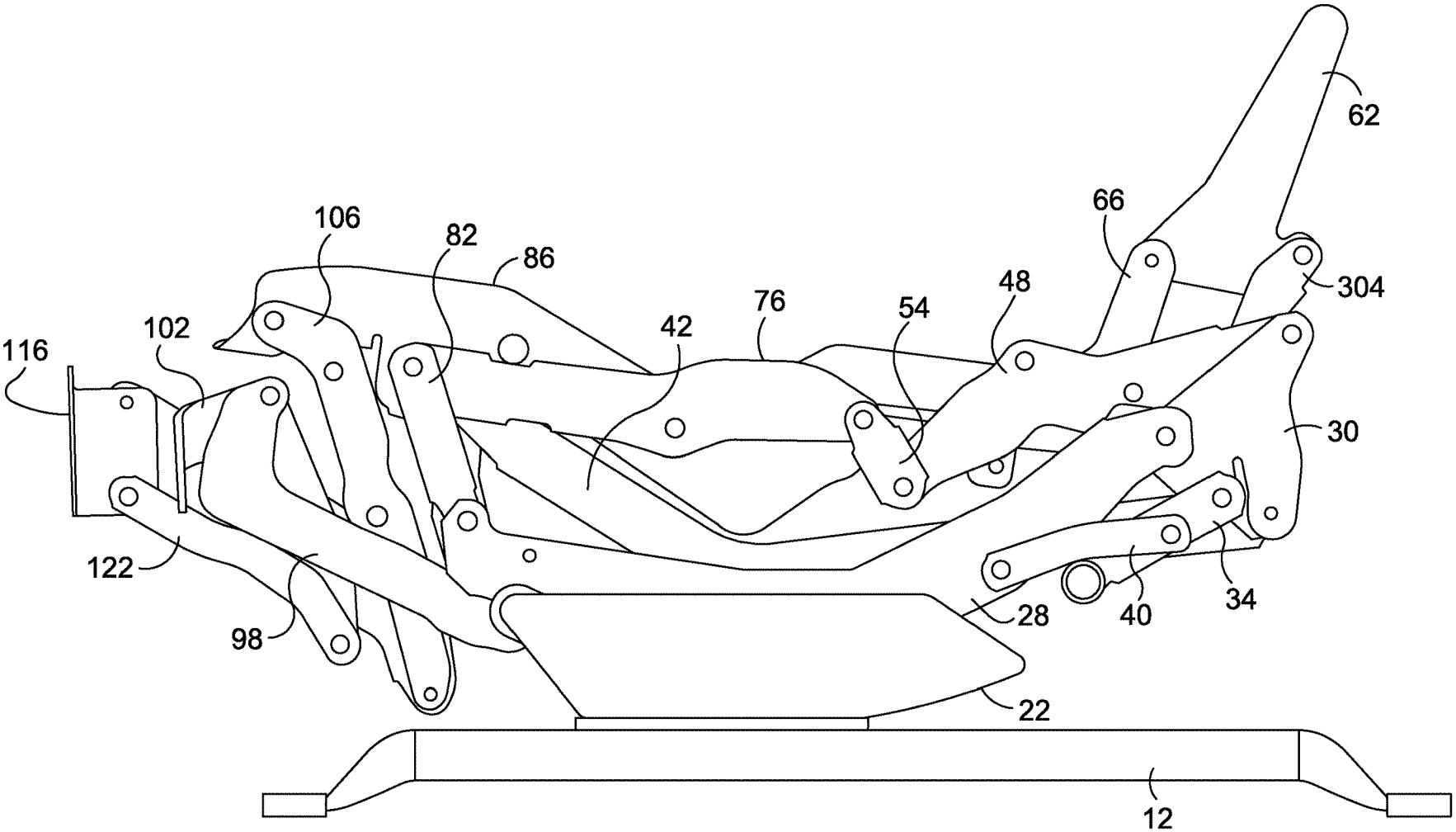
FIG. 17 is an inside, cross-sectional view of the rocker mechanism of FIG. 16 in accordance with an embodiment of the invention.

Recline mechanism 26 moves between the closed position of FIGS. 1-3, to the TV position of FIGS. 4-6, to the full-recline position of FIGS. 7-9. The arrangement of recline mechanism 26 provides a projected pivot point for the chair back that is close to the point at which the bottom of a chair back and the back of a seat cushion meet, when in a finished chair. In styling a finished chair, the manufacturer can design the chair back and seat such that they meet as close to this projected pivot point as possible. The back bracket 62 pivotably coupled to rear back pivot link 58 and forward back pivot link 66, moved through control link 72 by the rear pivot link 30, rear lift link 48 and front lift link 76 allow the true pivot point of back bracket 62 (in relation to the seat mounting plate 86) to be projected forwardly, and above, the actual pivotable connection of back bracket 62.

Additionally, the connection of the motor 144 as described above allows the motor to extend and retract, while staying in a lower position as compared to traditional motorized rocker recliner mechanisms. The motor 144 is coupled to the rear ottoman link 92 rather than the front ottoman link 106. This connection, along with the control link 136, and the bent rear motor tubes 152 allow the motor to travel in a less arcuate path in operation, and to stay lower throughout its actuation. The recline mechanism 26 also uses more motor stroke to extend the seat to the full-recline position, so the transition from the TV position to the full-recline position is achieved in a slow, controlled manner that is comfortable to the user.

FIGS. 10-15 illustrate a similar recline mechanism in use on a motorized glider, as opposed to a rocker base. Due to the novel recline mechanism, much of the same linkage can be used on a glider base as was described above for the rocker base 10. In the glider base 200, spaced apart base rails 202 are coupled to one another through cross bars 204. In some aspects, the cross bars 204 may comprise tubular steel or steel angle iron. A glide bracket 206 is fixedly coupled to a corresponding base rail 202. A front glide link 208 is pivotably coupled to the glide bracket 206 at pivot point 210, and a rear glide link 212 is pivotably coupled to the glide bracket 206 at pivot point 214.

The glider base 200 is coupled to a recline mechanism 216 through a base plate 218. More specifically, the lower end of front guide link 208 and the lower end of rear guide link 212 are pivotably coupled to base plate 218 at pivot points 220 and 222, respectively. Base plate 218 thus reciprocates, or glides, with respect to glider base 200 on front and rear glide links 208, 212. A rear link 224 is pivotably coupled to the rear end of base plate 218 at pivot point 226. The upper end of rear link 224 is pivotably coupled to rear pivot link 30.

On the glider mechanism, additional links are included to block the gliding motion in the TV and full-recline positions. Blocker control link 228 is pivotably coupled to footrest drive link 42 at pivot point 230. The opposite end of blocker control link 228 is pivotably coupled to a hook link 232 at pivot point 234. Hook link 232 has an L-shape, with a hook slot 236 generally mid-way along the link. The slot 236 engages a stop pin 238 to prevent gliding motion when in the TV or full-recline positions. The end of hook link 232 opposite pivot point 234 is pivotably coupled to base plate 218 at pivot point 240. A front blocker control link 242 is pivotably coupled to footrest drive link 42 at pivot point 244.

The opposite end of front blocker control link 242 is pivotably coupled to a front blocker link 246 at pivot point 248. The front blocker link 246 has a wheel 250 that abuts the front glide link 208 when in the TV or full-recline position.

The remainder of the recline mechanism 216 is the same as the recline mechanism 26 described above, and so it will not be described further here. The links and pivot points are labeled in the Figures with the same numbers as used above with respect to FIGS. 1-9. The glider of FIGS. 10-15 has the same projected back pivot point, and low motor mount features as described above for the rocker of FIGS. 1-9.

Figure 18:
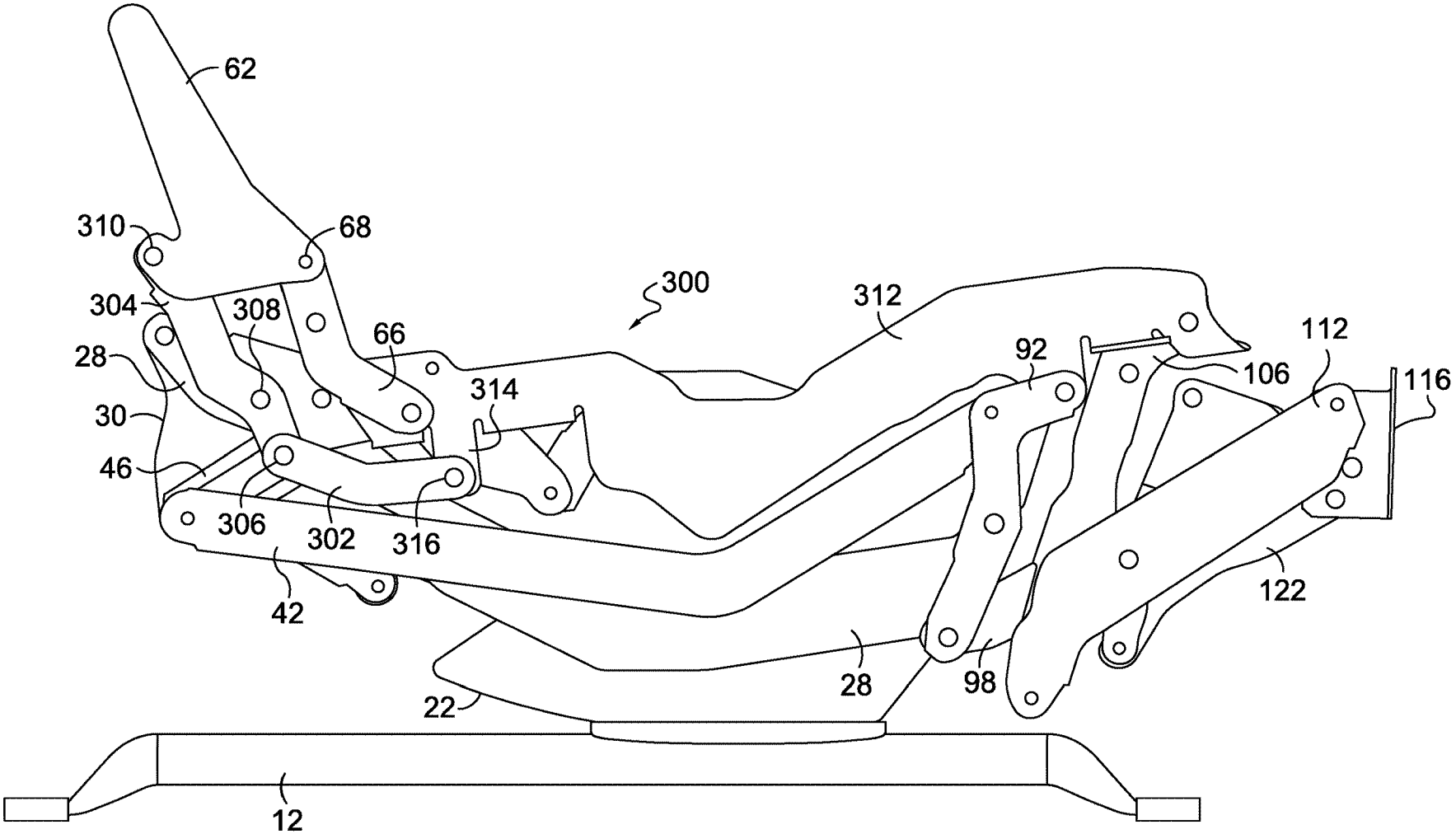
FIG. 18 is an outside elevation view of the chair base of FIG. 16 in accordance with an embodiment of the invention.
Figure 19:
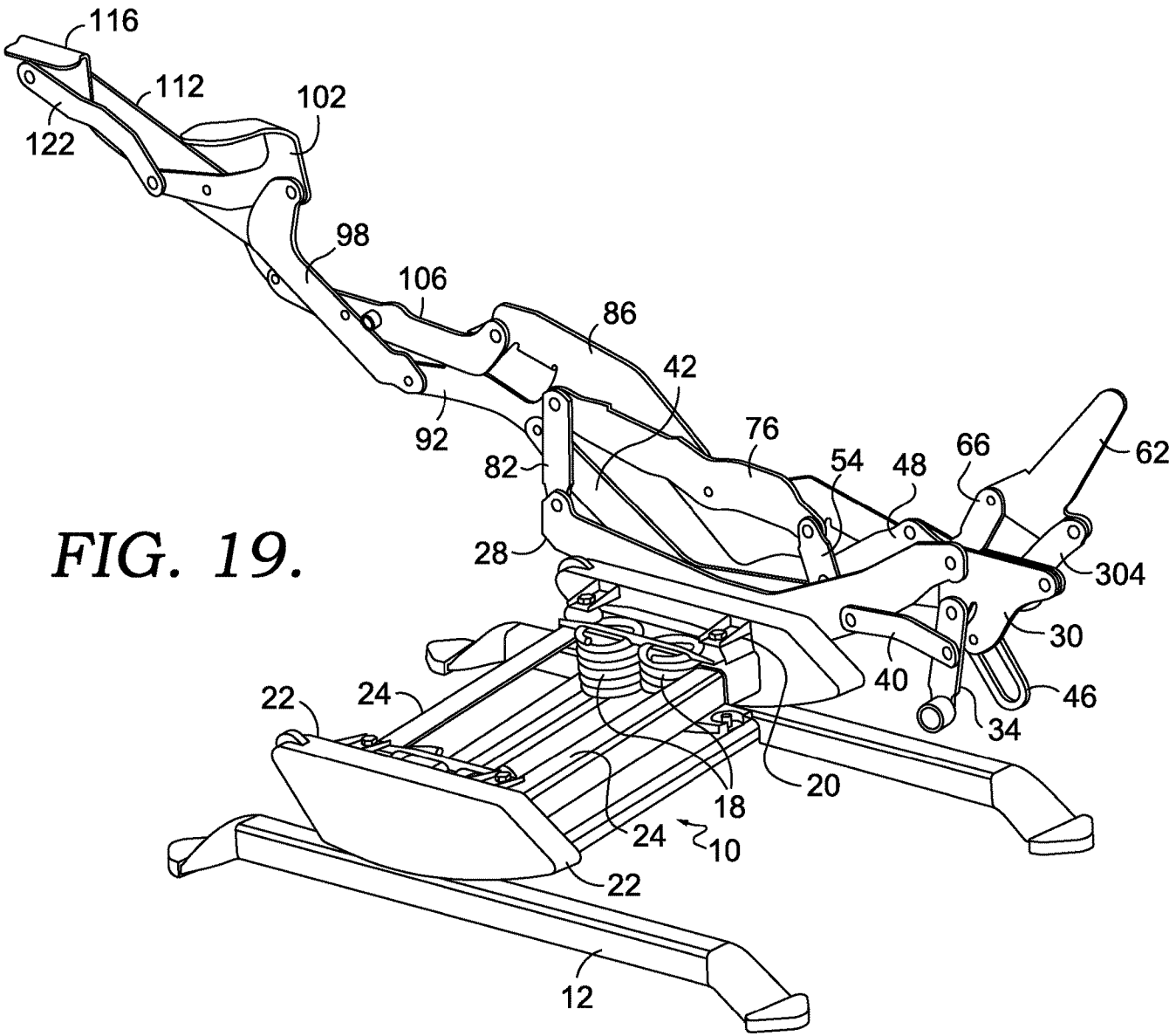
FIG. 19 is a perspective view of the rocker chair base of FIG. 16 in a TV position in accordance with an embodiment of the invention.
Figure 20:
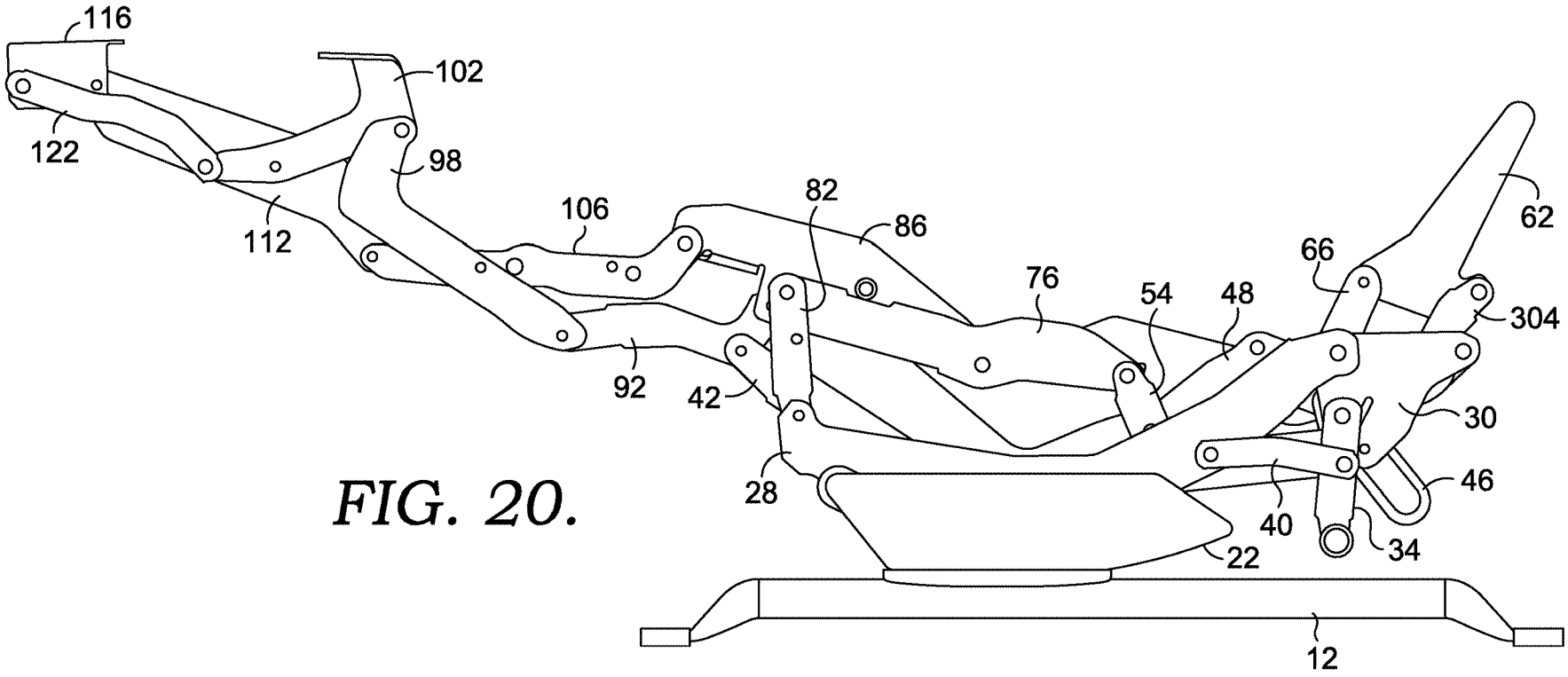
FIG. 20 is an inside, cross-sectional view of the rocker mechanism of FIG. 19 in accordance with an embodiment of the invention.
Figure 21:
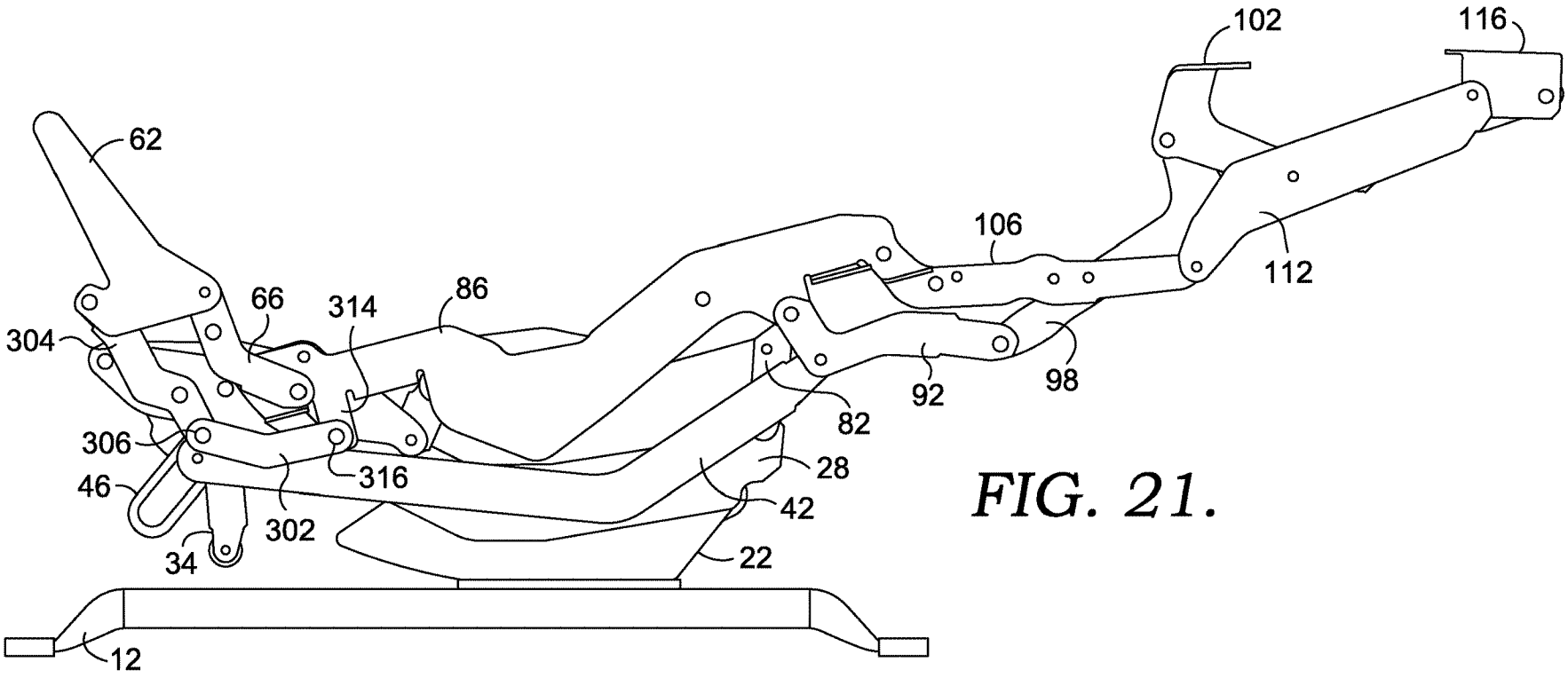
FIG. 21 is an outside elevation view of the mechanism of FIG. 19 in accordance with an embodiment of the invention.
Figure 22:
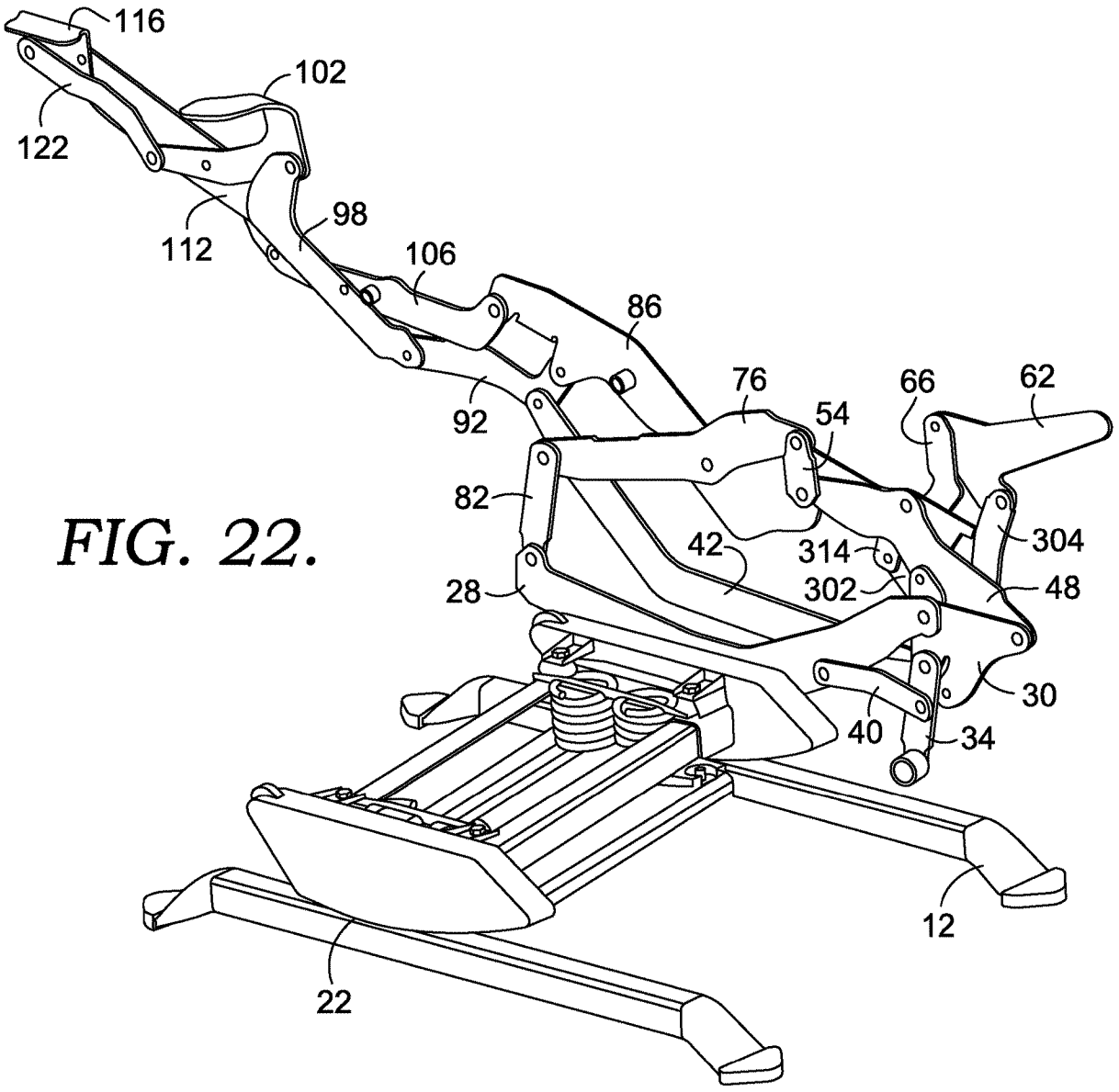
FIG. 22 is a perspective view of the rocker chair base of FIG. 16 in a fully-reclined position in accordance with an embodiment of the invention.
Figure 23:
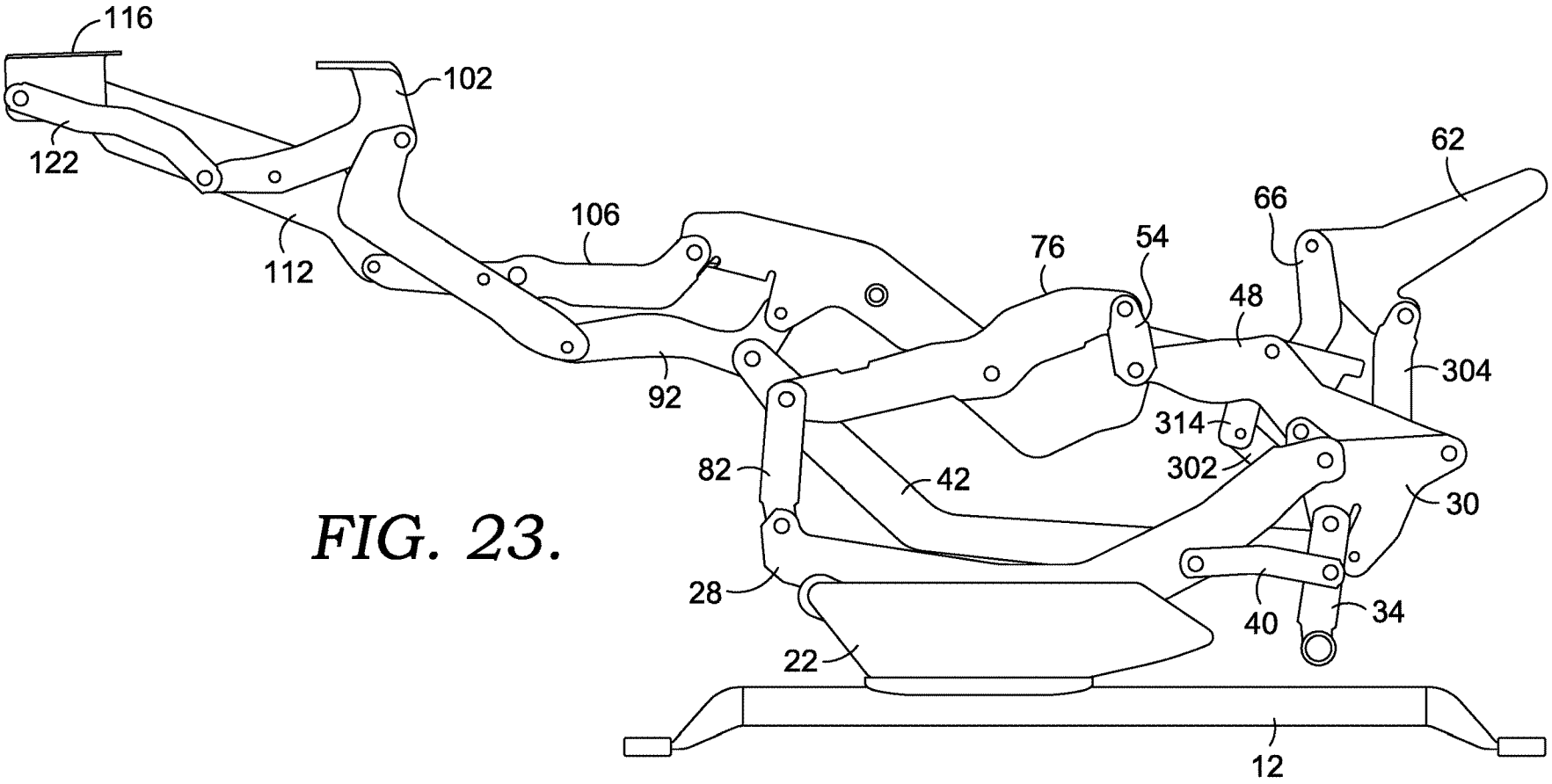
FIG. 23 is an inside, cross-sectional view of the rocker mechanism of FIG. 22 in accordance with an embodiment of the invention.
Figure 24:
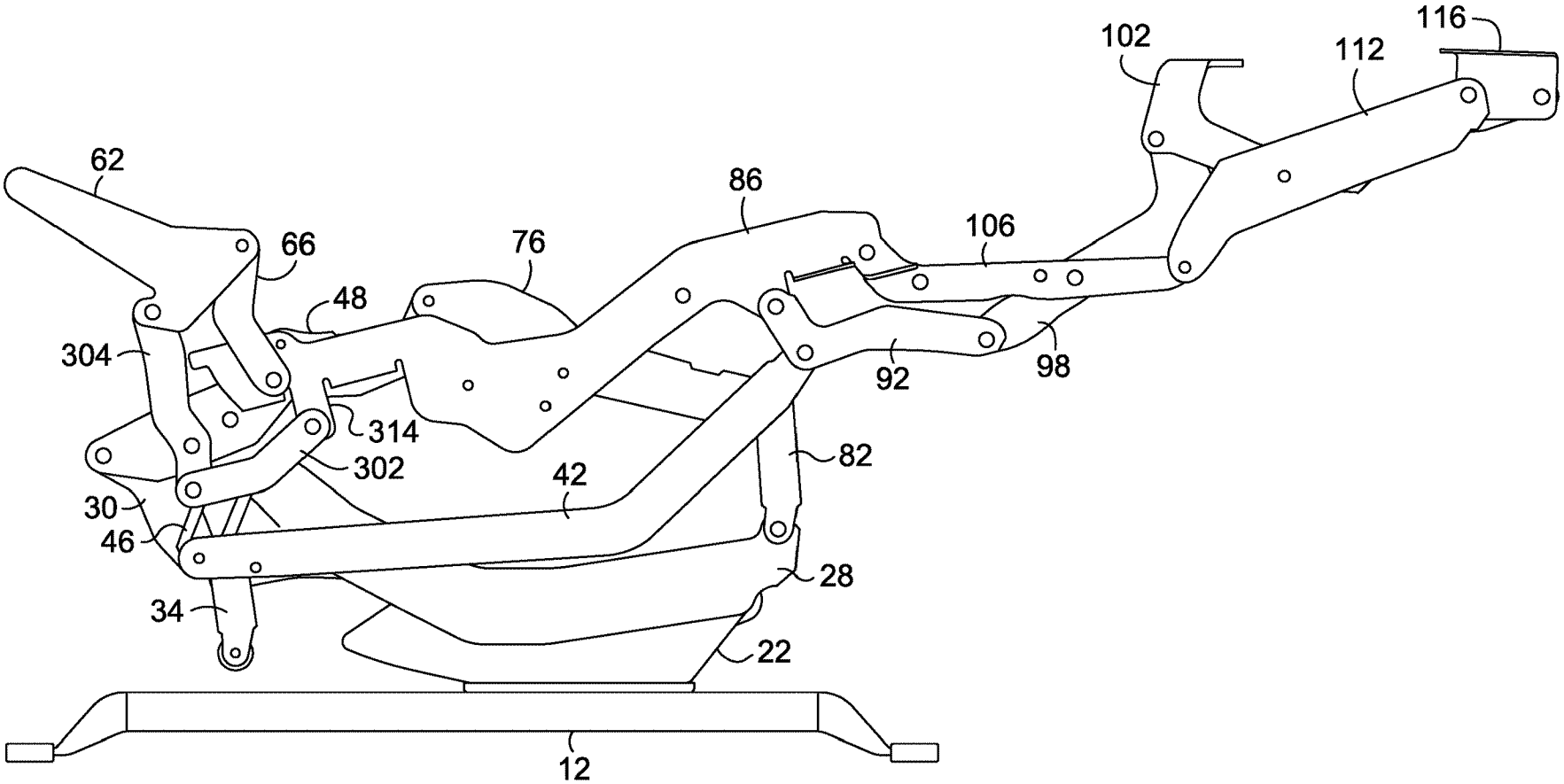
FIG. 24 is an outside elevation view of the mechanism of FIG. 22 in accordance with an embodiment of the invention.

FIGS. 16-24 illustrate an alternate embodiment of a mechanism 300, shown on a rocker base 10 constructed as described above with respect to FIGS. 1-9. Much of the mechanism 300 shares links common to those described above with respect to recline mechanism 26. The links common to mechanism 300 are labeled with the same reference numbers. Mechanism 300 is shown on a manual rocker, without any motor. Mechanism 300 could, of course, be motorized. In the embodiment of FIGS. 16-24, control link 72 is replaced with control link 302, as best seen in FIG. 18. To accommodate control link 302, rear back pivot link 304 is longer than rear back pivot link 58 of FIGS. 1-15. Rear back pivot link 304 is pivotably coupled to control link 302 at pivot point 306, to rear lift link 48 at pivot point 308, and to back bracket 62 at pivot point 310. A slightly varied seat mounting plate 312 is used in this embodiment. Seat mounting plate 312 has a downwardly extending tab 314 that is used to pivotably couple the end of control link 302 opposite pivot point 306, at pivot point 316. As the mechanism 300 moves from closed to TV to full recline, control link 302 moves back bracket 62, guided by forward back pivot link 66 and rear back pivot link 304. The mechanism 300 provides an alternate construction for projecting the back pivot point, so that the back pivots with respect to the seat in a manner similar to that described above with respect to FIGS. 1-15. Such an arrangement could also be implemented on a glider base, with similar modifications made as described above with respect to FIGS. 10-15, but using the alternative control link 302 (and the connection of the control link 302) as described in FIGS. 16-24.

Figure 25:
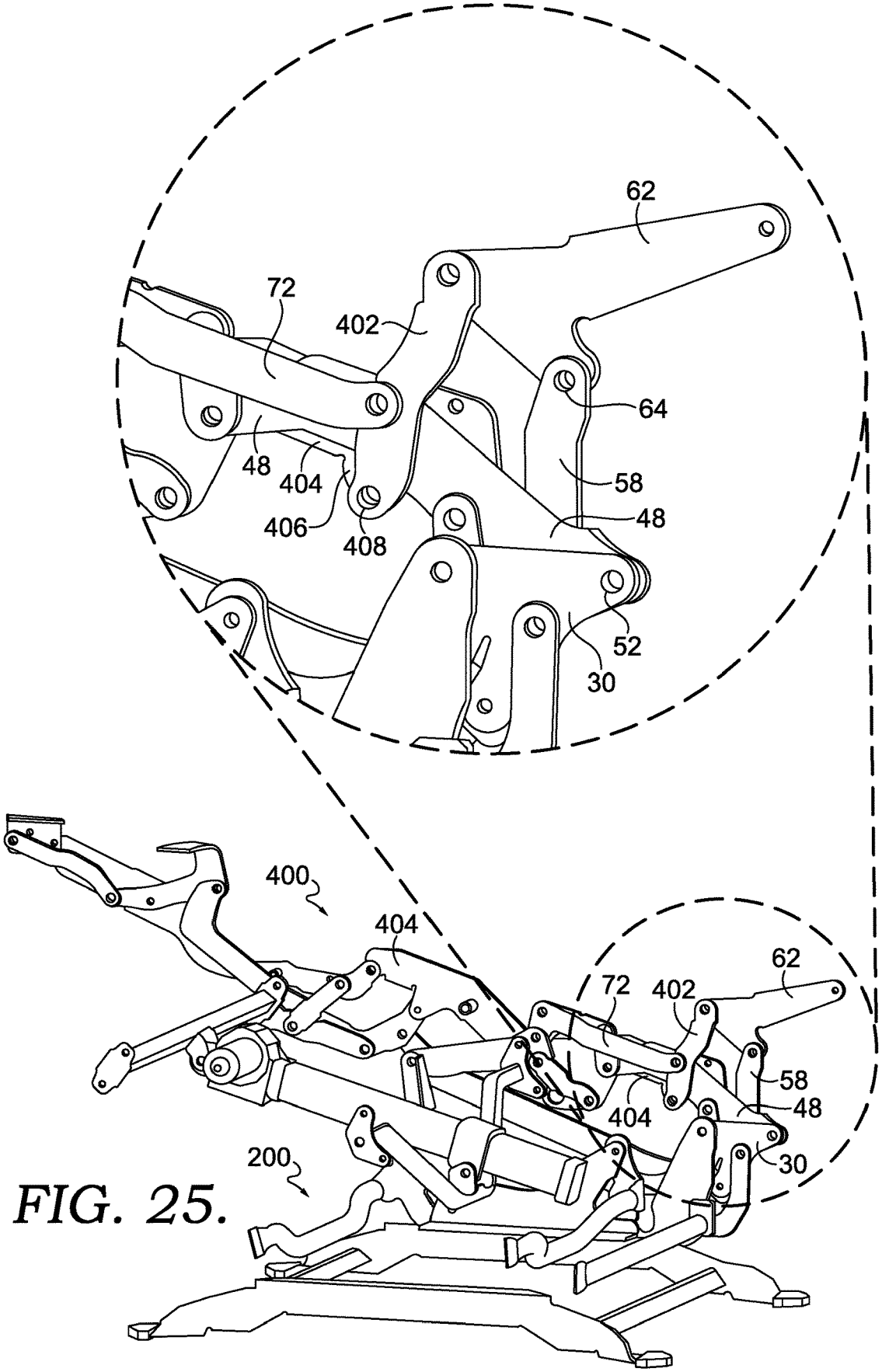
FIG. 25 is a perspective view of an exemplary motorized glider chair base in a fully-reclined position in accordance with an embodiment of the invention.
Figure 26:
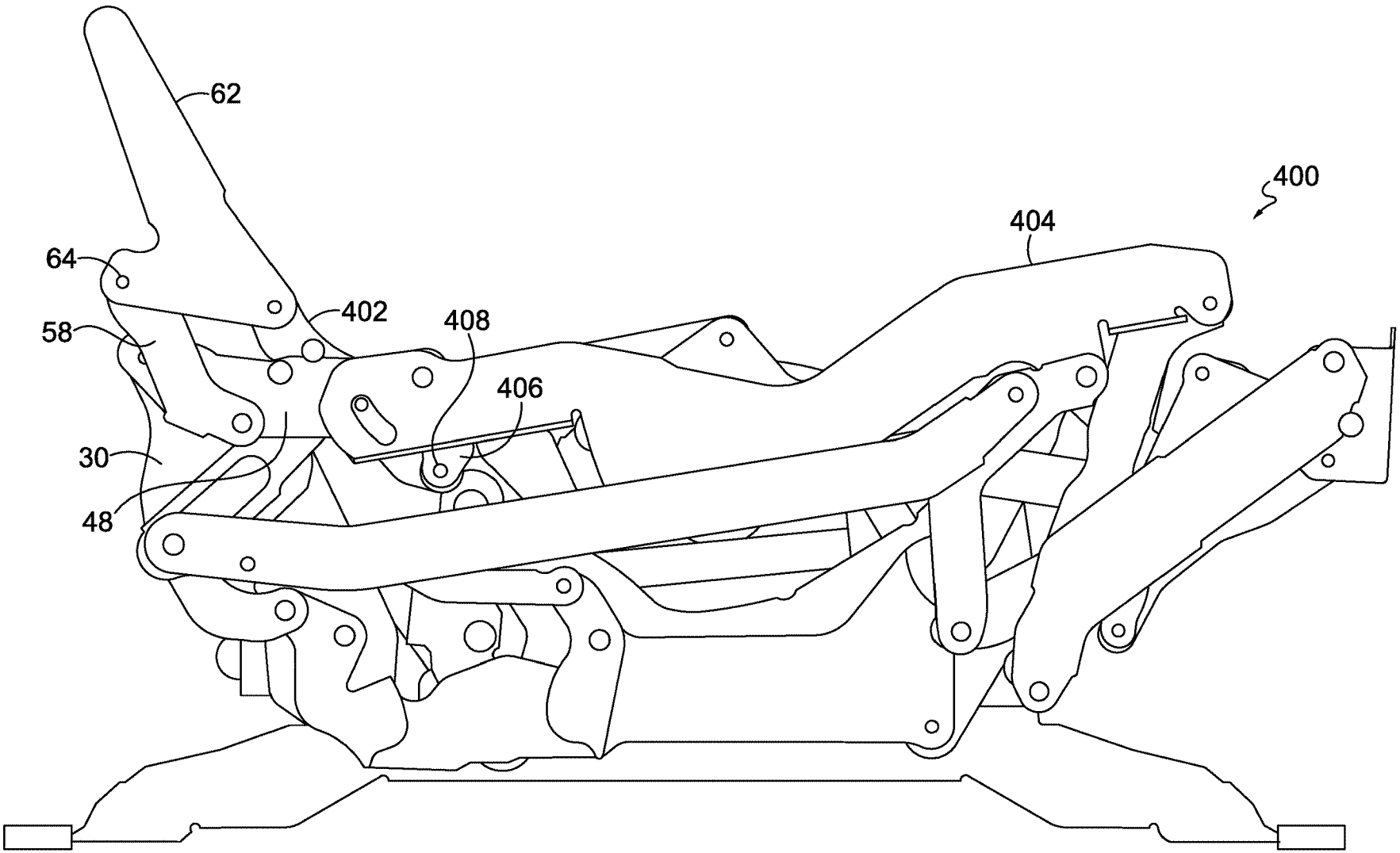
FIG. 26 is an outside elevation view of the mechanism of FIG. 25 in accordance with an embodiment of the invention.

FIGS. 25 and 26 illustrate another alternative embodiment of a mechanism 400, shown on a glider base 200 constructed as described above with respect to FIGS. 10-15. Much of the mechanism 400 shares links common to those described above with respect to the recline mechanism 26. The links common to mechanism 400 are labeled with the same reference numbers. Mechanism 400 is shown on a motorized glider. Mechanism 400 could, of course, be constructed as a manual glider. In the embodiment of FIGS. 25 and 26, the forward back pivot link 66 is replaced with forward back pivot link 402. Further, the seat mounting plate 86 has been replaced with seat mounting plate 404. The seat mounting plate 404 includes a tab 406 that extends below a flange of the seat mounting plate 404, as best seen in FIG. 26. As shown in FIG. 25, in this embodiment the forward back pivot link 402 connects directly to the seat mounting plate 404 at pivot point 408, as opposed to connecting to the rear lift link 48 at pivot point 70 as discussed above in reference to the recline mechanism 26. In order to accommodate the movement of the rear lift link 48, the forward back pivot 402 link may include an offset that allows the forward back pivot 402 to avoid the rear lift link 48 as the mechanism 400 moves. The mechanism 400 provides an alternate construction for projecting the back pivot point, so that the back pivots with respect to the seat in a manner similar to that described above with respect to FIGS. 1-15. Such an arrangement could also be implemented on a rocker base, with similar modifications as described above with respect to FIGS. 1-9, but using the alternative control link 302 (and the connection of the control link 302) as described in reference to FIGS. 16-24.

Some aspects of this disclosure have been described with respect to the illustrative examples provided by FIGS. 1-24. Additional aspects of the disclosure will now be described that may related subject matter included in one or more claims of this application, or one or more related applications, but the claims are not limited to only the subject matter described in the below portions of this description. These additional aspects may include features illustrated by FIGS. 1-24, features not illustrated by FIGS. 1-24, and any combination thereof. When describing these additional aspects, reference may or may not be made to elements depicted by FIGS. 1-24.

One aspect disclosed herein is directed to a linkage for use in reclining furniture. The linkage may include a back bracket and a rear lift link positioned below the back bracket. The linkage may also include a forward back pivot link pivotally coupled to the back bracket at a first pivot point and pivotally coupled at a second pivot point to one of a seat mounting plate and the rear lift link. The linkage may also include a rear back pivot link pivotally coupled to the back bracket at a third pivot point and pivotally coupled to the rear lift link at a fourth pivot point. The third pivot point may be rearward of the first pivot point and the fourth pivot point may be rearward of the second pivot point. The linkage may also include a control link having a first end opposite a second end. The first end may be pivotally coupled to the forward back pivot link at a fifth pivot point. The second end may be pivotally coupled to a front lift link. The fifth pivot point may be intermediate to the first pivot point and the third pivot point.

The linkage may be configured to move between a closed position and a fully reclined position. Further, the linkage may be configured to stop at one or more intermediate points between the closed position and the fully reclined position.

In aspects, upon movement of the linkage from the closed position to the fully reclined position, the back bracket rotates around a projected pivot point. The projected pivot point may be forward and above the first pivot point when the linkage is in the closed position. The projected pivot point may be rearward and above the first pivot point when the linkage is in the fully reclined position.

In other aspects, upon movement of the linkage from the closed position to the fully reclined position the forward back pivot link may rotate about the third pivot point and the first pivot point may move forwardly and upwardly.

The control link may include a mounting tab proximate the second end. A motor may be coupled to the mounting tab and configured to move the linkage between a closed position and a fully reclined position.

When configured for use in a rocker recliner, the linkage may further include a base, a rocker cam coupled to the base and a base plate coupled to the rocker cam. A front pivot link may be pivotally coupled to the base plate proximate a first end of the base plate. Similarly, a rear pivot link may be pivotally coupled to the base plate proximate a second end of the base plate, the first end being spaced apart from the second end. The rear pivot link may be pivotally coupled to the rear lift link and the front pivot link may be pivotally coupled to the front lift link.

When configured for use in a glider, the linkage may further include a glider base and a base plate coupled to the glider base. The front lift link may be pivotally coupled to the base plate proximate a first end of the base plate. A rear pivot link may be pivotally coupled to the base plate proximate a second end of the base plate, the first end being spaced apart from the second end. The rear pivot link may be pivotally coupled to the rear lift link.

Another aspect disclosed herein is directed to a linkage for use in reclining furniture. The linkage may include a back bracket, a seat mounting plate, a rear lift link, a forward back pivot link, a rear back pivot link, and a control link. The forward back pivot link may be pivotally coupled to the back bracket at a first pivot point and pivotally coupled to the seat mounting plate at a second pivot point. The rear back pivot link may be pivotally coupled to the back bracket at a third pivot point and pivotally coupled to the rear lift link at a fourth pivot point. The third pivot point may be rearward of the first pivot point and the fourth pivot point may be rearward of the second pivot point. The control link may have a first end opposite a second end. The first end may be pivotally coupled to the rear back pivot link at a fifth pivot point. The second end may be pivotally coupled to the seat mounting plate. The fourth pivot point may be intermediate to the second pivot point and the fifth pivot point.

In some aspects, the rear back pivot link has a first end opposite a second end. The second pivot point may be positioned proximate the first end of the rear back pivot link. The fifth pivot point may be positioned proximate the second end of the rear back pivot link. In other aspects, the second end of the control link may be pivotally coupled to a tab extending from the seat mounting plate.

Another aspect disclosed herein is directed to a motor-driven seating unit. The motor-driven seating unit may include a first linkage coupled to a first side of a base unit and a second linkage coupled to a second side of the base unit opposite the first side. The first and second linkages may be configured to move between a closed position where an ottoman portion is folded and an open position where the ottoman portion is unfolded. A cross-tube may be coupled on a first end to the ottoman portion of the first linkage at a first rear ottoman link. The cross-tube may be coupled on a second end to the ottoman portion of the second linkage at a second rear ottoman link. A motor may be coupled to the cross-tube and configured to move the first and second linkages between the closed position and the open position.

In some aspects, a first bracket may be coupled to the first rear ottoman link at a first pivot point. The first end of the cross-tube may be fixedly coupled to the first bracket. A first ottoman control link may be pivotally coupled to the first bracket between the first pivot point and the fixed coupling. The first ottoman control link may be pivotally coupled to a first front ottoman link of the ottoman portion of the first linkage. Further, a second bracket may be coupled to the second rear ottoman link at a second pivot point. The second end of the cross-tube may be fixedly coupled to the second bracket. A second ottoman control link may be pivotally coupled to the second bracket between the second pivot point and the fixed coupling. The second ottoman control link may be pivotally coupled to a second front ottoman link of the ottoman portion of the second linkage. A clevis may be fixedly coupled to the cross-tube and the motor may be pivotally coupled to the clevis.

In other aspects, the motor includes a track and a drive block that is configured to move along the track as the first and second linkages move between the closed position and the open position. A first motor bell crank may be pivotally coupled to a first control link of the first linkage and a second motor bell crank may be pivotally coupled to a second control link of the second linkage. A rear motor tube having a third end opposite a fourth end may extend between the first and second linkages. The rear motor tube may be fixedly coupled on the third end to the first motor bell crank and fixedly coupled on the fourth end to the second motor bell crank. The rear motor tube may be pivotally coupled to the drive block. The first motor bell crank may be pivotally connected to a first seat mounting plate of the first linkage. The second motor bell crank may be pivotally connected to a second seat mounting plate of the second linkage. The motor-driven seating unit may comprise one of a rocker seating unit or a glider seating unit.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A linkage for use in reclining furniture comprising:

a seat mounting plate;

a back bracket;

a rear lift link positioned below the back bracket, wherein the rear lift link is coupled to the seat mounting plate;

a forward back pivot link pivotally coupled to the back bracket at a first pivot point and pivotally coupled at a second pivot point to one of the seat mounting plate or the rear lift link;

a rear back pivot link pivotally coupled to the back bracket at a third pivot point and pivotally coupled to the rear lift link at a fourth pivot point, the third pivot point being rearward of the first pivot point, the fourth pivot point being rearward of the second pivot point; and a control link having a first end opposite a second end, the first end pivotally coupled to the forward back pivot link at a fifth pivot point, and the second end pivotally coupled to a front lift link, the fifth pivot point being intermediate to the first pivot point and the second pivot point.

2. The linkage of claim 1, wherein the linkage is configured to move between a closed position and a fully reclined position.

3. The linkage of claim 2, wherein the linkage is configured to stop at one or more intermediate points between the closed position and the fully reclined position.

4. The linkage of claim 2, whereupon movement of the linkage from the closed position to the fully reclined position, the back bracket rotates around a projected pivot point.

5. The linkage of claim 4, wherein the projected pivot point is forward and above the first pivot point when the linkage is in the closed position.

6. The linkage of claim 4, wherein the projected pivot point is rearward and above the first pivot point when the linkage is in the fully reclined position.

7. The linkage of claim 1, whereupon movement of the linkage from a closed position to a fully reclined position the forward back pivot link rotates about the second pivot point and the first pivot point moves forwardly and upwardly.

8. The linkage of claim 1, wherein the control link includes a mounting tab proximate the second end, wherein a motor is coupled to the mounting tab and is configured to move the linkage between a closed position and a fully reclined position.

9. The linkage of claim 1 further comprising:

a base;

a rocker cam coupled to the base;

a base plate coupled to the rocker cam;

a front pivot link pivotally coupled to the base plate proximate a first end of the base plate;

a rear pivot link pivotally coupled to the base plate proximate a second end of the base plate, the first end being spaced apart from the second end;

the rear pivot link pivotally coupled to the rear lift link; and the front pivot link pivotally coupled to the front lift link.

10. The linkage of claim 1 further comprising:

a glider base;

a base plate coupled to the glider base;

the front lift link pivotally coupled to the base plate proximate a first end of the base plate;

a rear pivot link pivotally coupled to the base plate proximate a second end of the base plate, the first end being spaced apart from the second end, the rear pivot link pivotally coupled to the rear lift link.

11. A linkage for use in reclining furniture comprising:

a back bracket;

a seat mounting plate;

a rear lift link;

a forward back pivot link pivotally coupled to the back bracket at a first pivot point and pivotally coupled to the seat mounting plate at a second pivot point;

a rear back pivot link pivotally coupled to the back bracket at a third pivot point and pivotally coupled to the rear lift link at a fourth pivot point, the third pivot point being rearward of the first pivot point, the fourth pivot point being rearward of the second pivot point; and a control link having a first end opposite a second end, the first end pivotally coupled to the rear back pivot link at a fifth pivot point, and the second end pivotally coupled to the seat mounting plate, the fourth pivot point being intermediate to the second pivot point and the fifth pivot point.

12. The linkage of claim 11, wherein the rear back pivot link has a first end opposite a second end, the third pivot point is positioned proximate the first end of the rear back pivot link and the fifth pivot point is positioned proximate the second end of the rear back pivot link.

13. The linkage of claim 11, wherein the second end of the control link is pivotally coupled to a tab extending from the seat mounting plate.

* * * * *